US008396391B2

(12) United States Patent
Yamashita

(10) Patent No.: US 8,396,391 B2
(45) Date of Patent: Mar. 12, 2013

(54) ELECTROPHOTOGRAPHIC COLOR IMAGE FORMING APPARATUS

(75) Inventor: Masatoshi Yamashita, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 12/781,950

(22) Filed: May 18, 2010

(65) Prior Publication Data

US 2011/0142488 A1 Jun. 16, 2011

(30) Foreign Application Priority Data

Dec. 10, 2009 (JP) ..... 2009-280308

(51) Int. Cl.
*G03G 21/16* (2006.01)

(52) U.S. Cl. ..... 399/111

(58) Field of Classification Search ..... 399/110, 399/111, 116, 117, 121, 124, 125
See application file for complete search history.

(56) References Cited

U.S. PATENT DOCUMENTS 5,752,133 A * 5/1998 Nagase et al. ..... 399/112
7,496,319 B2 * 2/2009 Takashima et al. ..... 399/227
7,853,176 B2 * 12/2010 Itabashi ..... 399/125
7,995,960 B2 * 8/2011 Kamimura ..... 399/357
8,185,013 B2 * 5/2012 Kikuchi et al. ..... 399/111

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A color image forming apparatus for forming a color image on a sheet includes a plurality of cartridge mounting portions for demountably mounting a cartridge each of which includes a developing roller for developing an electrostatic latent image formed on a photosensitive drum into a developed image and a developer accommodating portion for accommodating a developer to be used for development of the electrostatic latent image; a single intermediary transfer member which is provided opposed to the drums and onto which the developed images are transferred from the drums; an image forming unit containing the cartridge mounting portions and the intermediary transfer member and movable between a first position for transferring, onto the sheet, the developed images transferred onto the intermediary transfer member from the drums and a second position for permitting mounting and demounting of the cartridges relative to the cartridge mounting portion; an opening for permitting mounting and demounting of the cartridges relative to the cartridge mounting portions of the unit taking the a second position; and an opening-closing member movable between a closing position for closing the opening and an open position for opening the opening, wherein when the unit takes the first position, the cartridges take attitudes in which the developer is supplied to the developing roller by the weight thereof, and when the unit takes the a second position, the cartridges take attitudes in which the developer is not supplied to the developing roller by the weight thereof.

4 Claims, 21 Drawing Sheets

ELECTROPHOTOGRAPHIC COLOR IMAGE FORMING APPARATUS

FIELD OF THE INVENTION AND RELATED ART

The present invention relates to an electrophotographic color image forming apparatus which forms an image on recording medium, with the use of multiple cartridges removably mountable in its main assembly.

Here, an electrophotographic color image forming apparatus (which hereafter will be referred to simply as image forming apparatus) means such a color image forming apparatus that forms a color image on recording media with the use of an electrophotographic image formation process. Examples of an electrophotographic color image forming apparatus include color copying machines, color printers (color laser beam printer, color LED printers, etc.), color facsimile machines, color word processors, etc. Recording media include any medium on which an image can be formed by an image forming apparatus. They include paper, OHP sheet, and the like, for example.

A cartridge means a process cartridge, a development cartridge, or a developer (toner) cartridge, for example. It is removably mountable in the main assembly of an image forming apparatus. It contributes to a process for forming an image on recording medium by being in the main assembly of an image forming apparatus. A process cartridge is a cartridge in which a developing means (processing means) and an electrophotographic photosensitive drum (which hereafter will be referred to simply as drum) are integrally disposed. It can be removably mountable in the main assembly of an image forming apparatus. A process cartridge can be mounted into, or dismounted from, the main assembly of an image forming apparatus by a user himself or herself. Thus, it can make it easier to maintain an image forming apparatus. A processing means is a means for processing a drum.

A development cartridge has a development roller. It stores developer (toner) used in combination with the development roller to develop an electrostatic latent image on the drum. It also is removably mountable in the main assembly of an image forming apparatus. In the case of an image forming apparatus which uses a development cartridge, its drum is attached to the main assembly of the image forming apparatus, a cartridge supporting member of the apparatus, or is in a process cartridge of the so-called separation type (process cartridge having no developing means). A development cartridge also can be mounted into, or removed from, the main assembly of an image forming apparatus by a user himself or herself. Thus, it also can make it easier to maintain an image forming apparatus.

A developer cartridge (developer supply container) stores developer for developing an electrostatic latent image formed on a drum by a development roller. It also is removably mountable in the main assembly of an image forming apparatus. Incidentally, a drum and a development roller are attached to the main assembly of an image forming apparatus, or the cartridge-supporting member of the main assembly. The developer cartridge also can be mounted into, or removed from, the main assembly of an image forming apparatus by a user himself or herself. Therefore, it also can make it easier to maintain an image forming apparatus.

There has been known a color image forming apparatus structured as follows. It is structured so that its intermediary transferring member is rotated by the driving force source of its main assembly, and its photosensitive drum is rotated by the driving force source by way of the intermediary transferring member. This structural arrangement makes it easier to position a cartridge relative to the main assembly of an image forming apparatus when mounting the cartridge into the main assembly. That is, all that is necessary for a cartridge to be precisely positioned for image formation is for the cartridge to be precisely positioned relative to the intermediary transferring member. That is, this structural arrangement makes it easier to mount a cartridge into the main assembly of an image forming apparatus, to remove the cartridge from the main assembly, and also, to precisely position a cartridge relative to the main assembly.

SUMMARY OF THE INVENTION

The present invention is a further development of the above-described structural arrangement for an image forming apparatus. Thus, the primary object of the present invention is to provide an electrophotographic color image forming apparatus which is substantially smaller in the amount by which developer (toner) leaks when a cartridge is mounted into, or removed from, the main assembly of the apparatus, and is simpler in its mechanism for supplying the developing means with developer during an image forming operation, than any of the conventional image forming apparatuses.

According to an aspect of the present invention, there is provided a color electrophotographic image forming apparatus for forming a color image on a recording material, said color electrophotographic image forming apparatus comprising a plurality of cartridge mounting portions for demountably mounting a cartridge each of which includes a developing roller for developing an electrostatic latent image formed on an electrophotographic photosensitive drum into a developed image and a developer accommodating portion for accommodating a developer to be used for development of the electrostatic latent image; a single intermediary transfer member which is provided opposed to said electrophotographic photosensitive drums and onto which the developed images are transferred from said electrophotographic photosensitive drums; an image forming unit containing said cartridge mounting portions and said intermediary transfer member and movable between a transfer position for transferring, onto the recording material, the developed images transferred onto said intermediary transfer member from said electrophotographic photosensitive drums and a mounting and demounting position for permitting mounting and demounting of said cartridges relative to said cartridge mounting portion; an opening for permitting mounting and demounting of said cartridges relative to said cartridge mounting portions of said image forming unit taking the mounting and demounting position; and an opening-closing member movable between a closing position for closing said opening and an open position for opening said opening, wherein when said image forming unit takes the transfer position, said cartridges take attitudes in which the developer in said developer accommodating portions is supplied to said developing roller by the weight thereof, and when said image forming unit takes the mounting and demounting position, said cartridges take attitudes in which the developer in said developer accommodating portions is not supplied to said developing roller by the weight thereof.

The present invention can provide an electrophotographic color image forming apparatus which is substantially smaller in the amount by which developer (toner) leaks when a cartridge is mounted into, or removed from, the main assembly of the apparatus, and is simpler in its mechanism for supplying the developing means with developer during an image forming operation, than any of the conventional image forming apparatuses.

These and other objects, features, and advantages of the present invention will become more apparent upon consideration of the following description of the preferred embodiments of the present invention, taken in conjunction with the accompanying drawings.

Figure 1A:
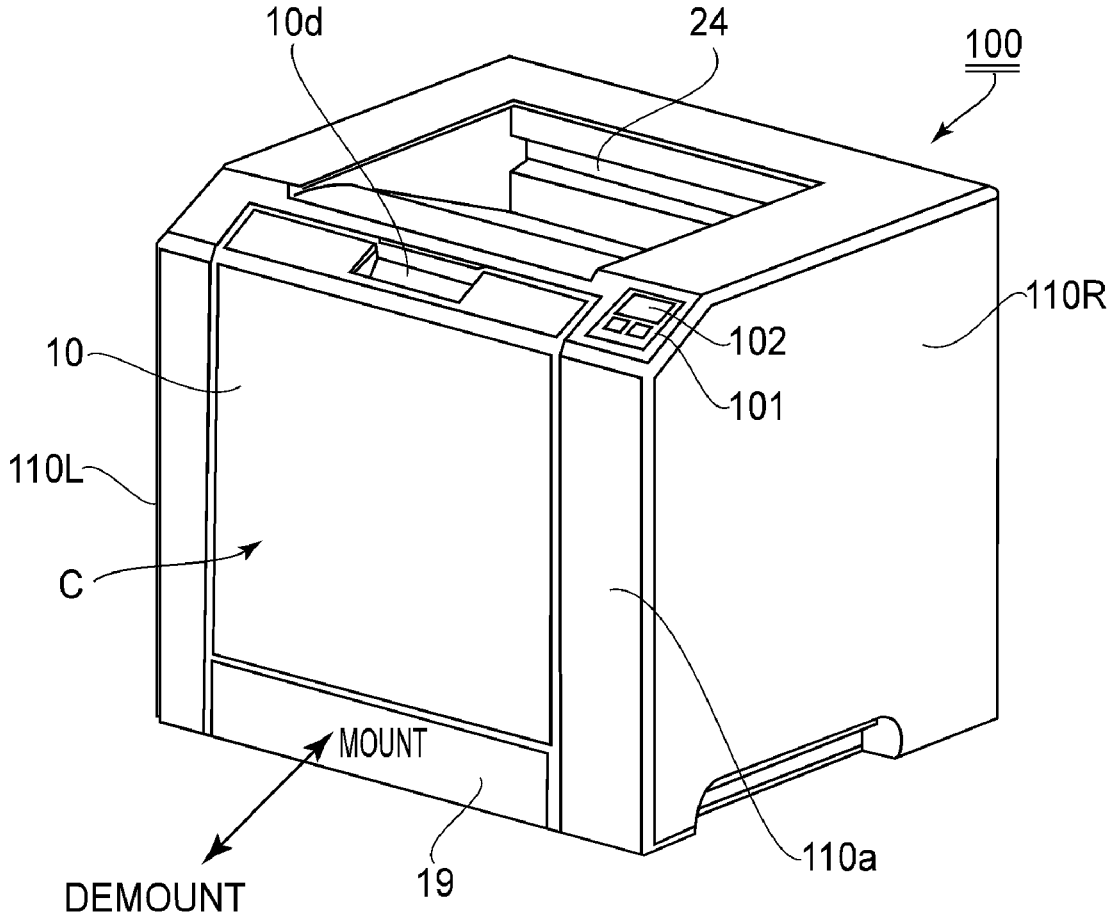
FIG. 1A is an external perspective view of an image forming apparatus of the first embodiment of the present invention.
Figure 1B:
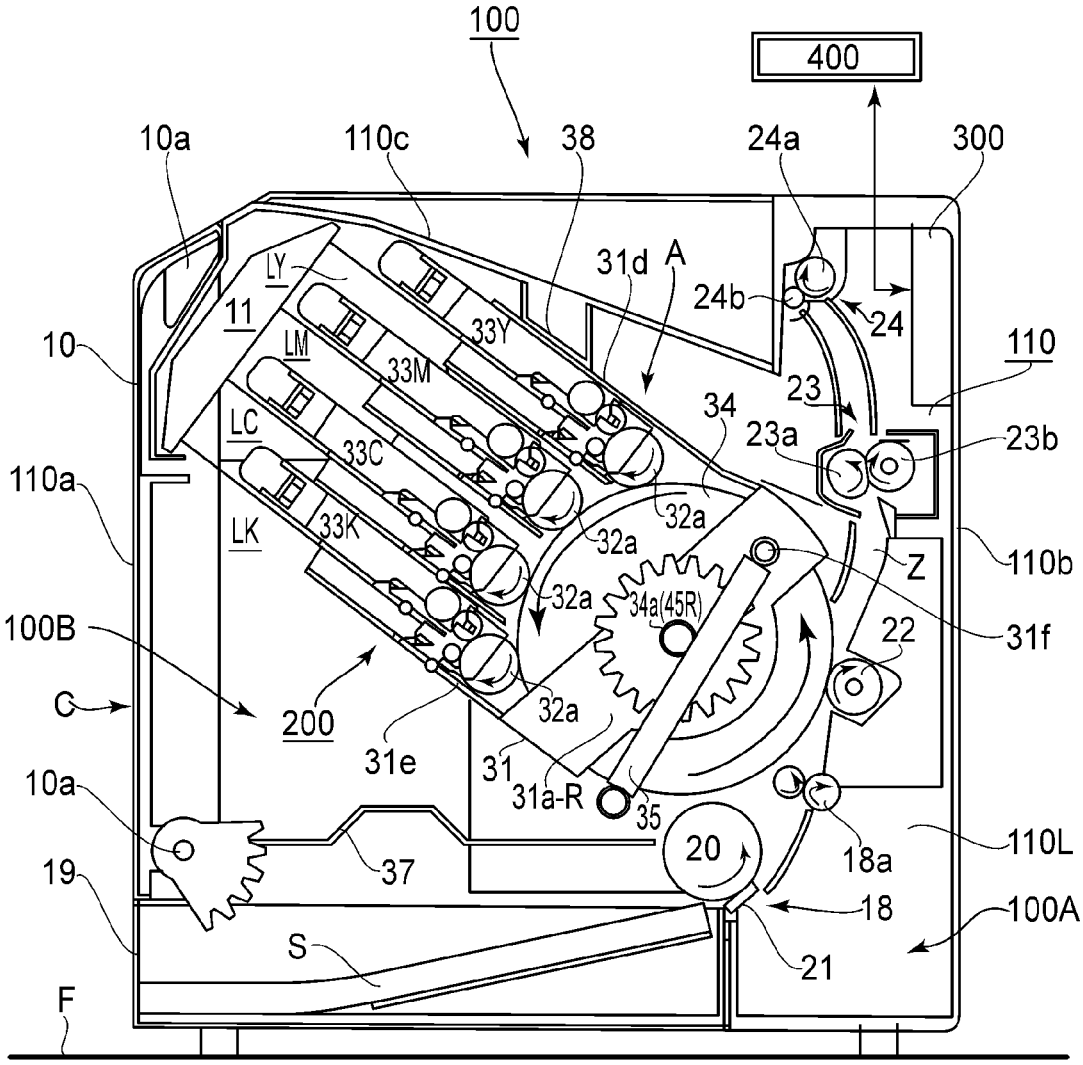
FIG. 1B is a schematic vertical sectional view of the right-hand portion of the image forming apparatus shown in FIG. 1A.
Figure 2:
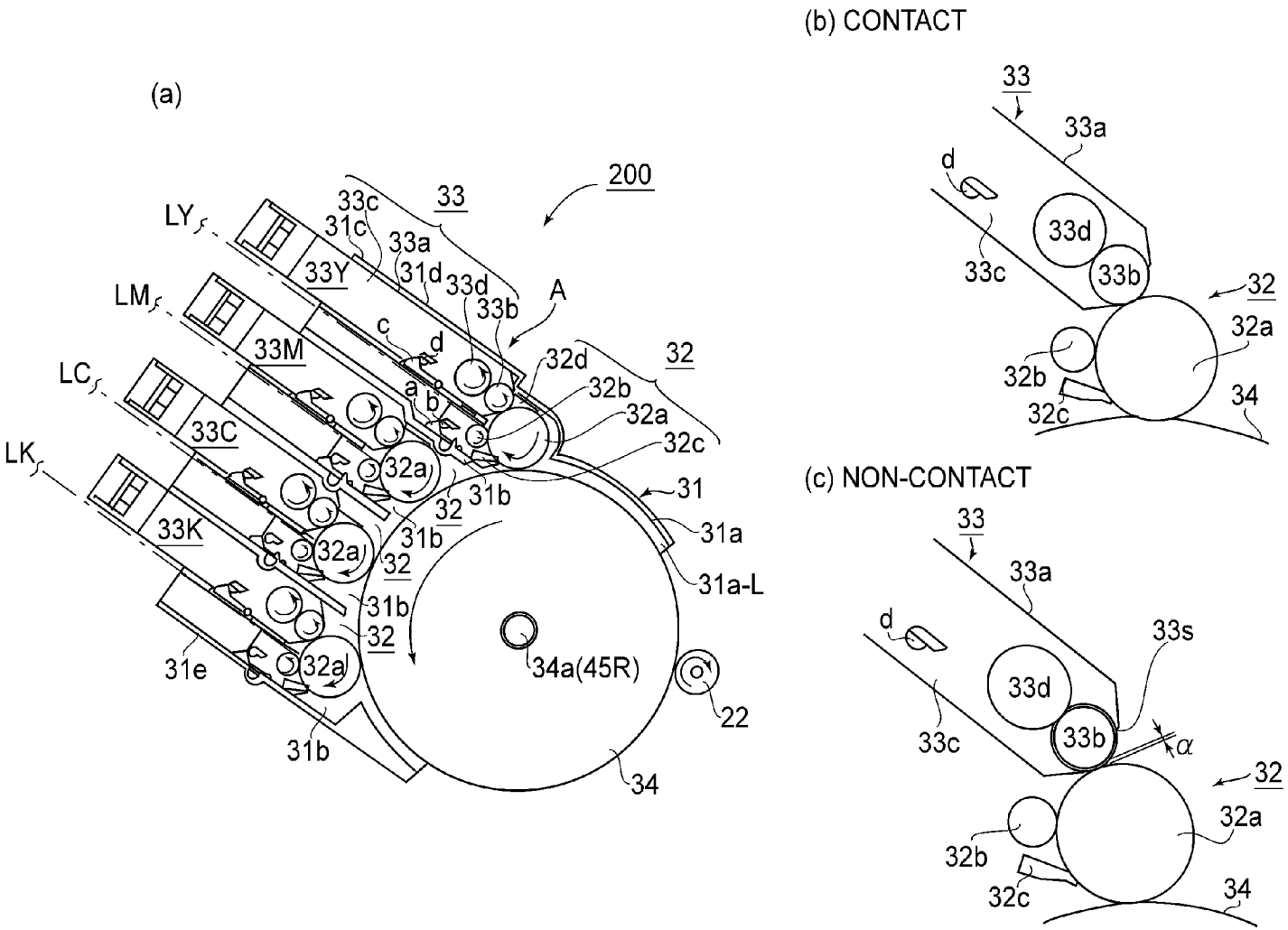

Part (a) of FIG. 2 is an enlargement of a part of FIG. 1B. Part (b) of FIG. 2 is a schematic drawing for describing a typical developing method of the contact type. Part (c) of FIG. 2 is a schematic drawing for describing a typical developing method of the noncontact type.

Figure 3:
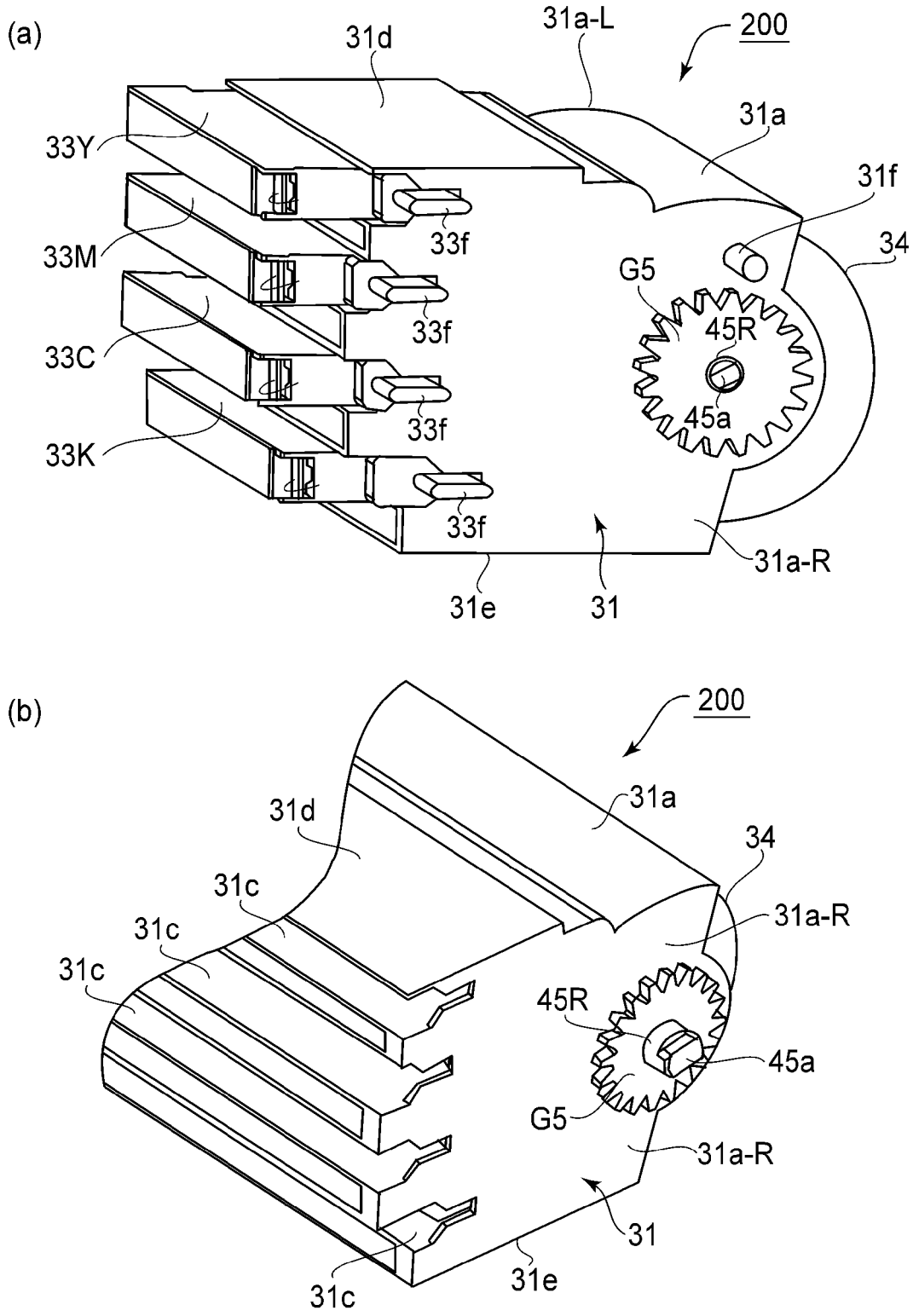

Part (a) of FIG. 3 is an external perspective view of the image formation unit, and (b) of FIG. 3 is a perspective view of the roughly right-hand half of the image formation unit, from which all the development cartridges have been removed.

Figure 4:
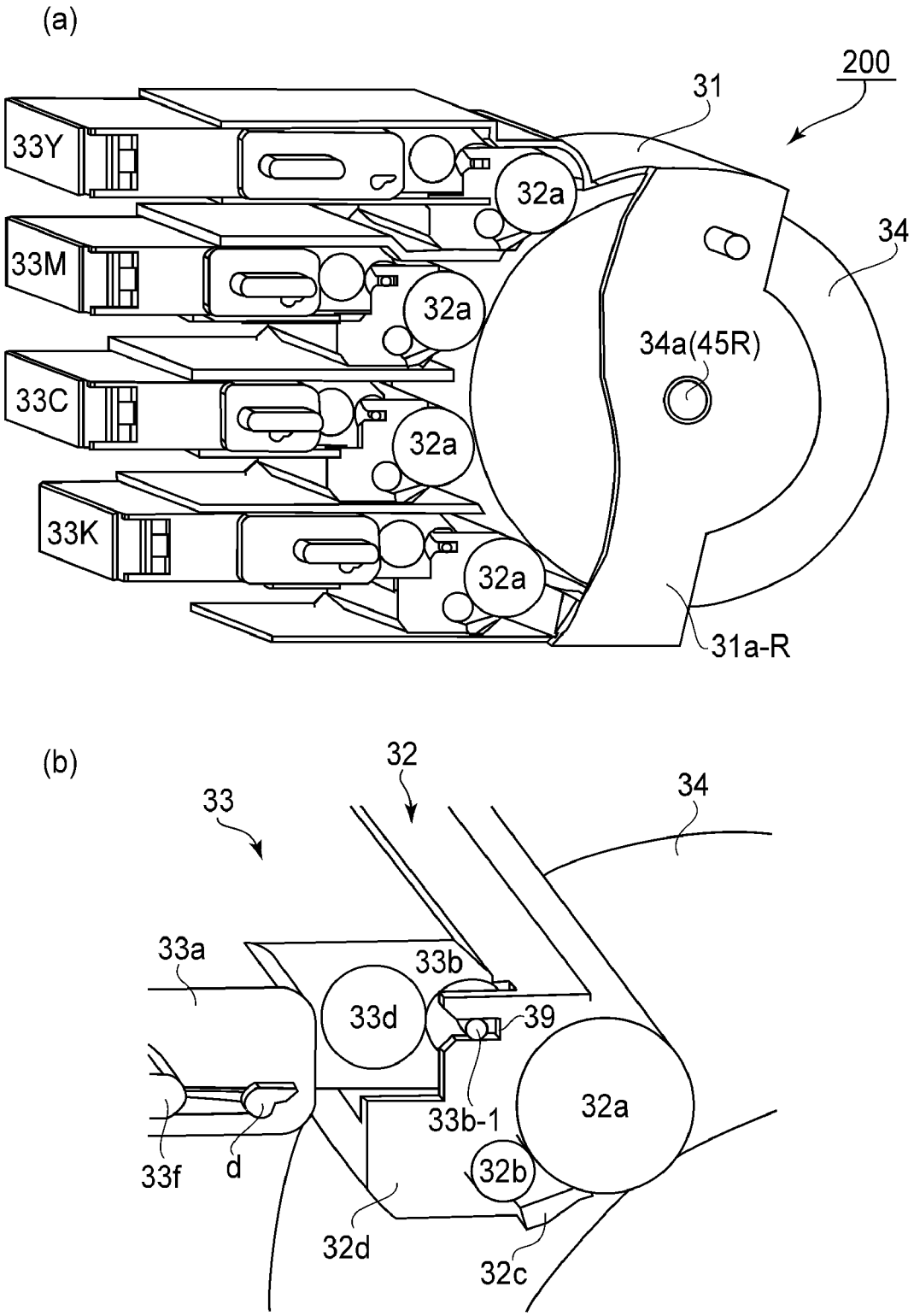

Part (a) of FIG. 4 is a perspective view of the portion of the image formation unit, which is for precisely positioning the development cartridges relative to the photosensitive drum unit, and (b) of FIG. 4 is an enlargement of a part of (a) of FIG. 4.

Figure 5A:
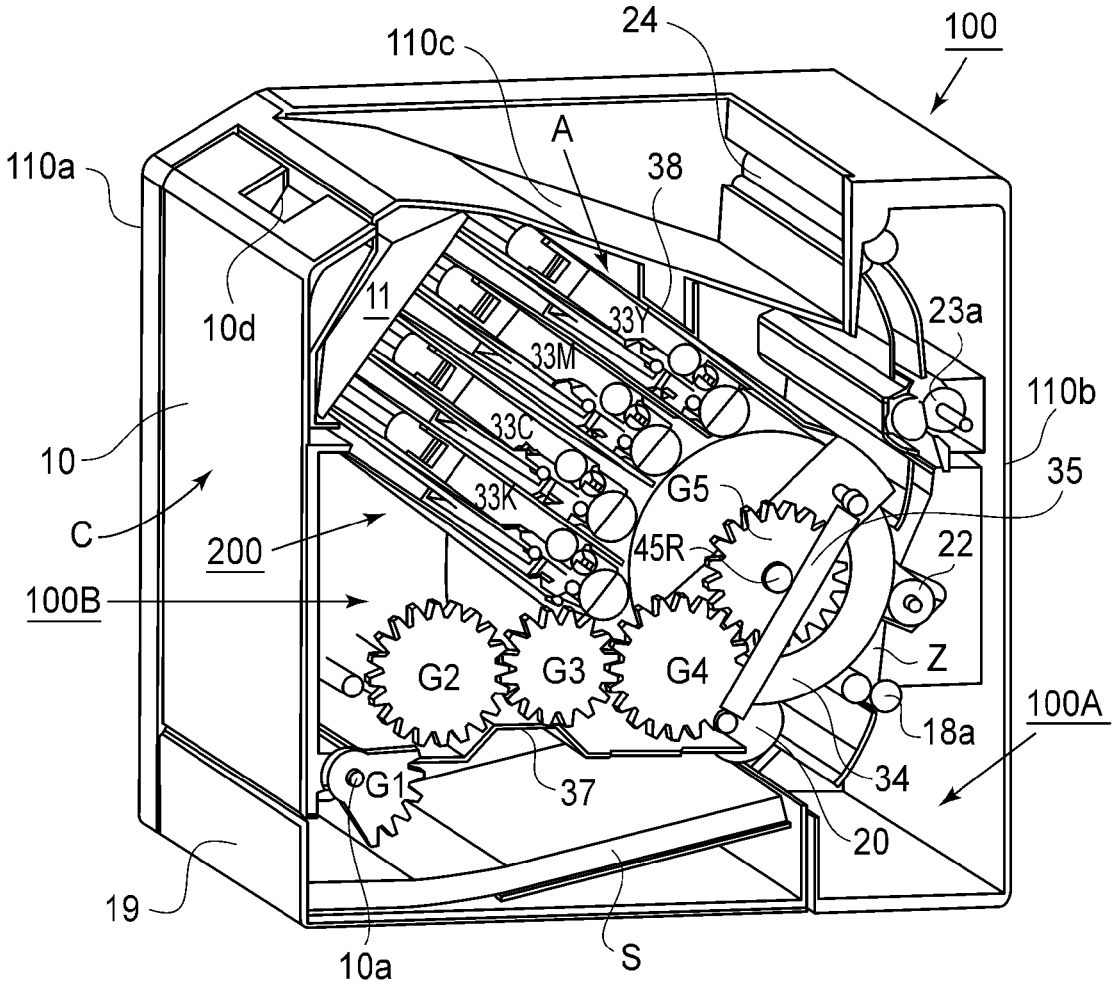
Figure 5B:
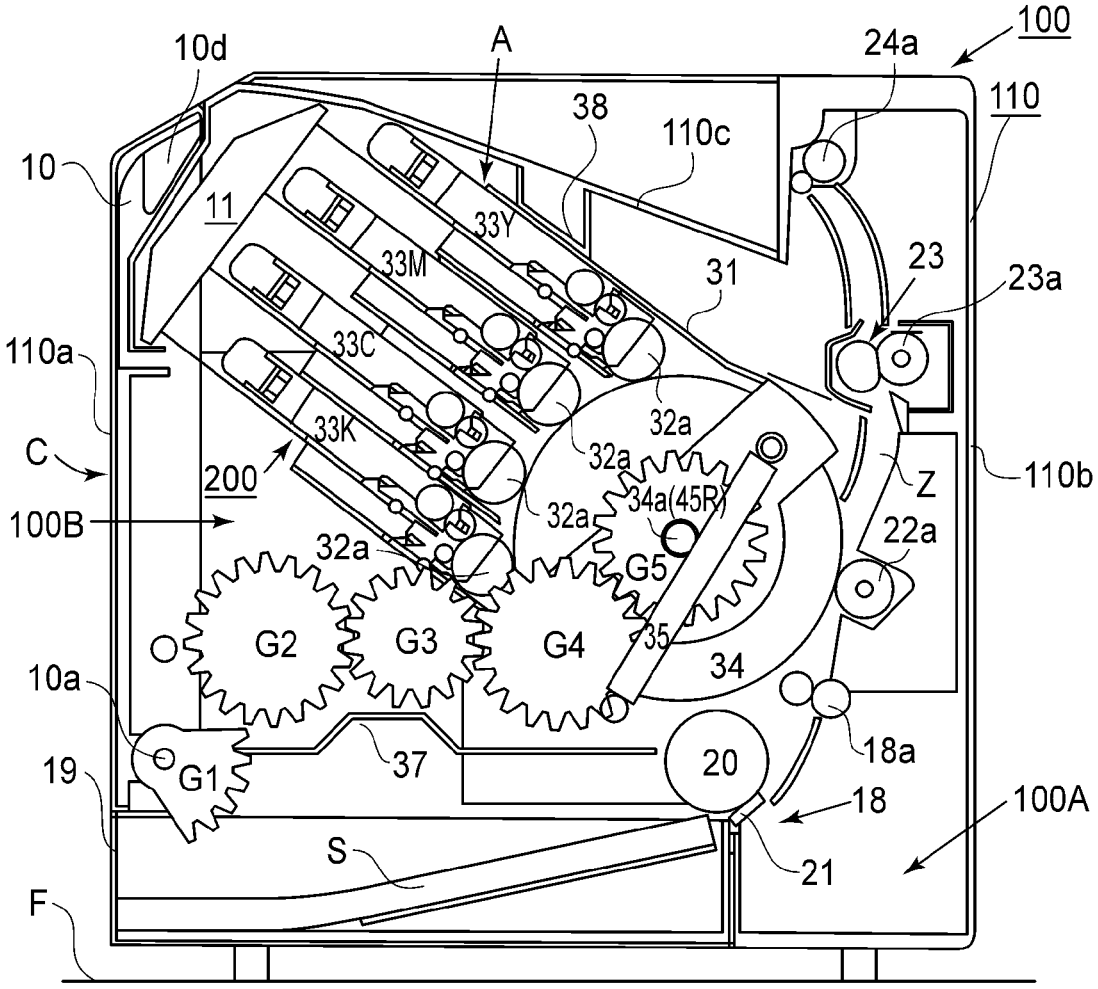

FIG. 5A is a perspective view of the image forming apparatus in the first embodiment, the cover of which is closed, and the image formation unit of which is in its image forming position. FIG. 5B is a vertical sectional view of the image forming apparatus in the first embodiment, the cover of which is closed, and the image formation unit of which is in its image forming position.

Figure 6A:
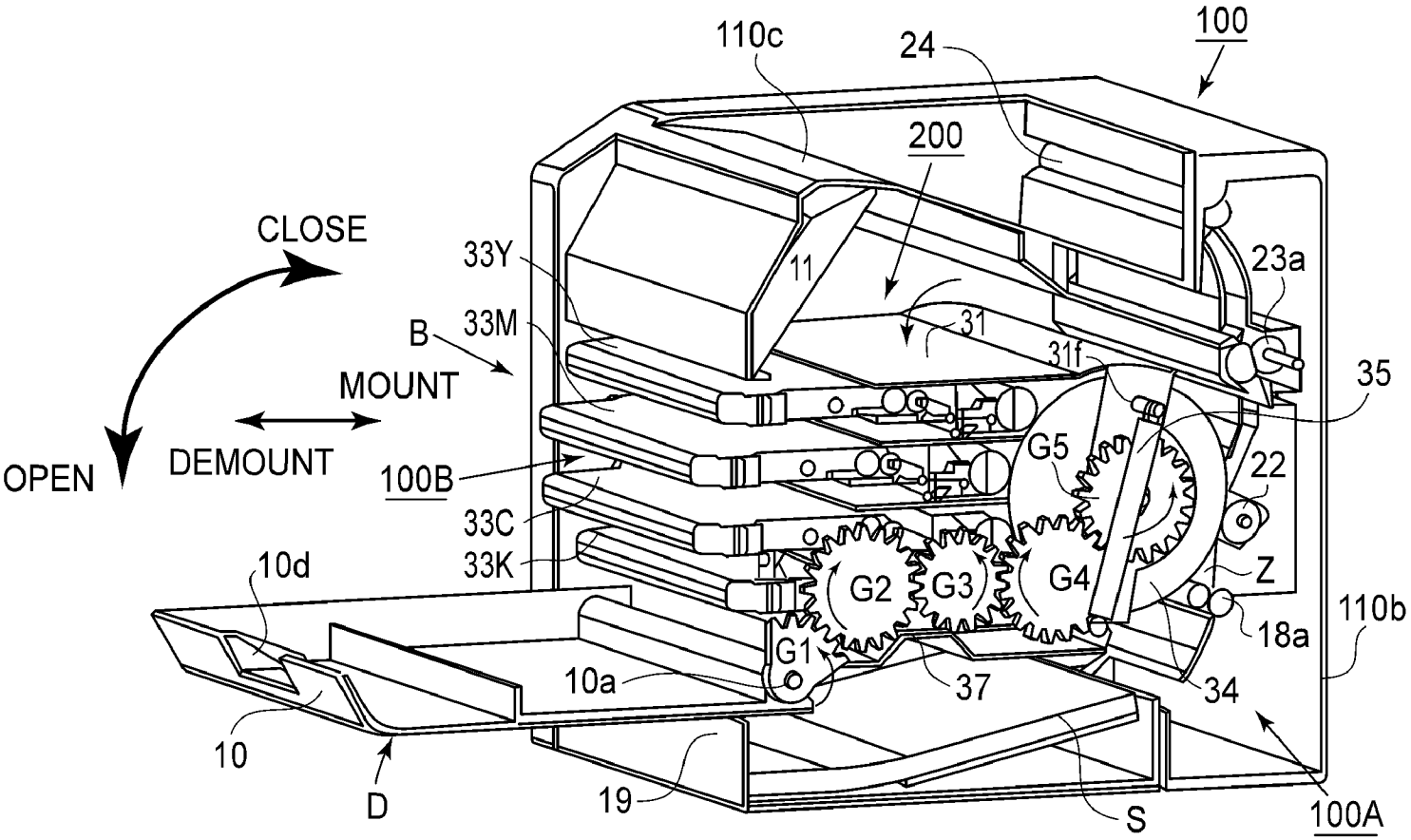
Figure 6B:
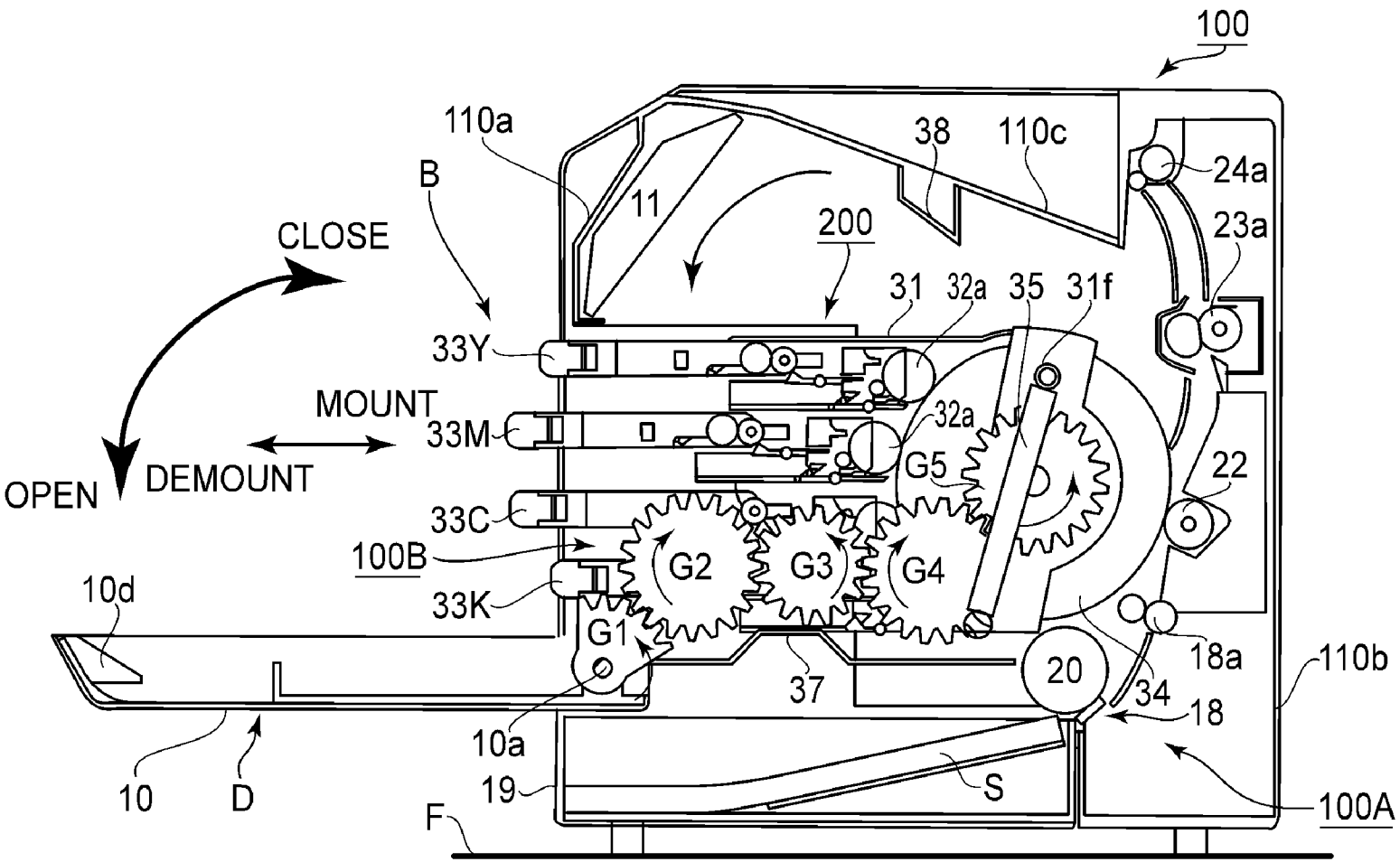

FIG. 6A is a perspective view of the image forming apparatus in the first embodiment, the cover of which is open, and the image formation unit of which is in the position for allowing cartridges to be mounted into, or removed from, the main assembly of the image forming apparatus. FIG. 6B is a vertical sectional view of the image forming apparatus in the first embodiment, the cover of which is open, and the image formation unit of which is in the position for allowing cartridges to be mounted into, or removed from, the main assembly of the image forming apparatus.

Figure 7A:
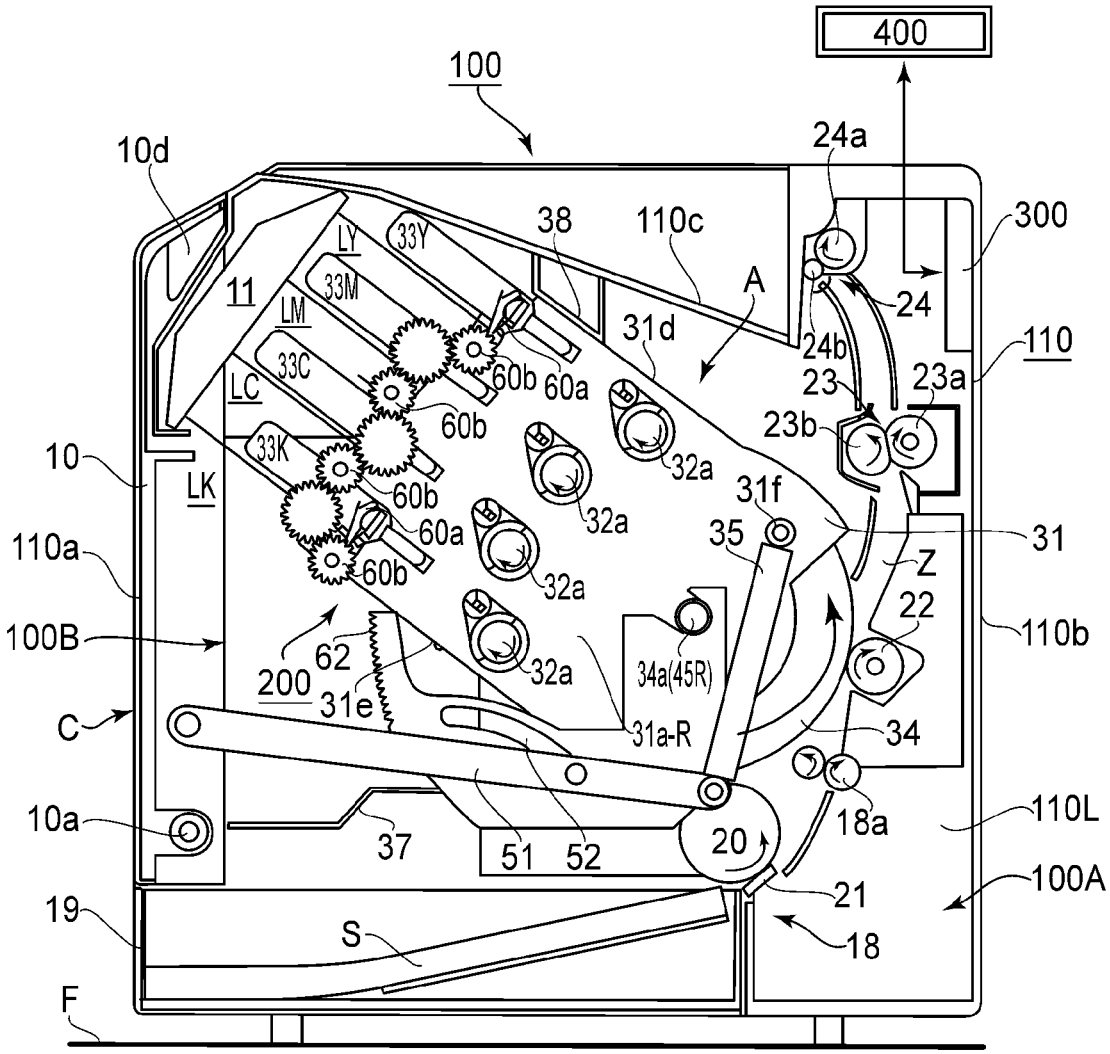
Figure 7B:
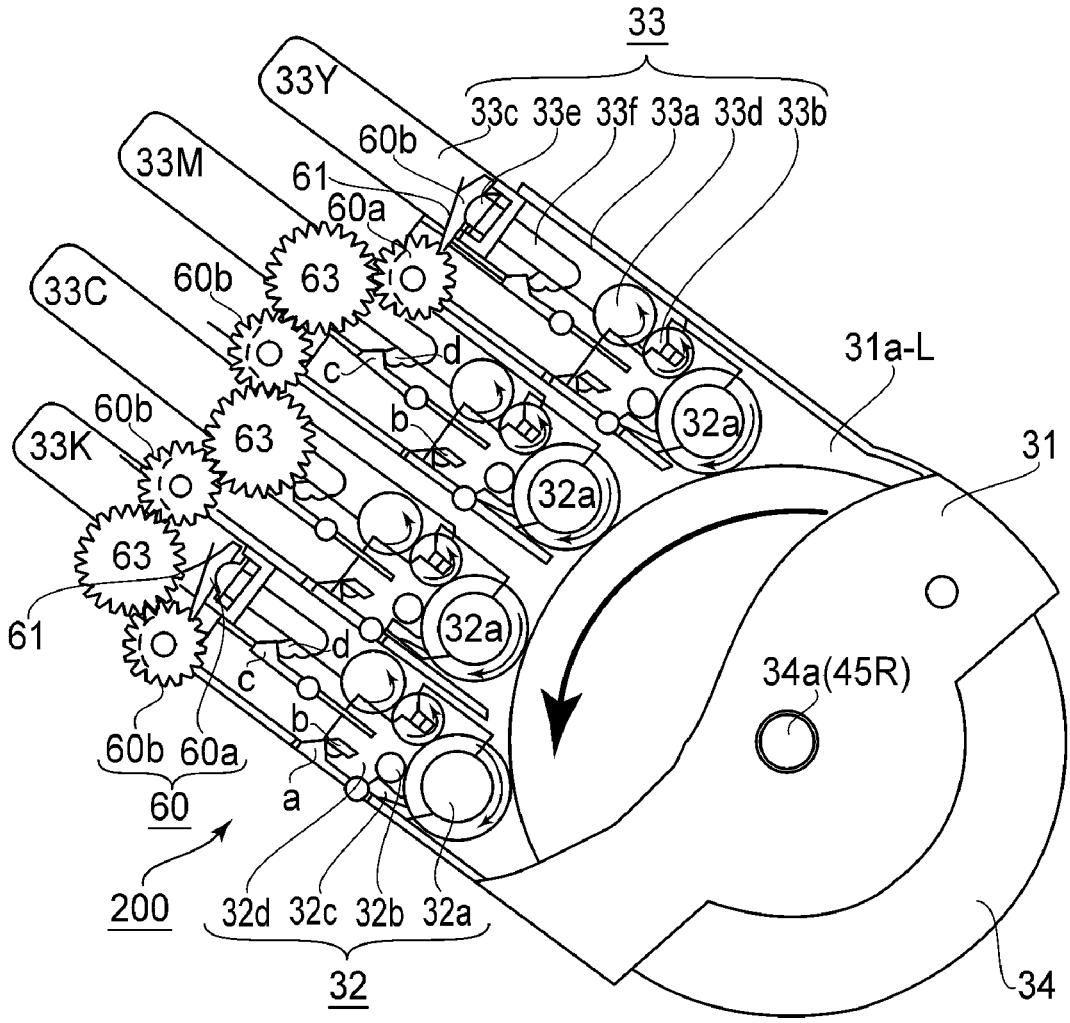

FIG. 7A is a schematic vertical sectional view of the image forming apparatus in the second embodiment of the present invention. FIG. 7B is an enlargement of a part of FIG. 7A.

Figure 8A:
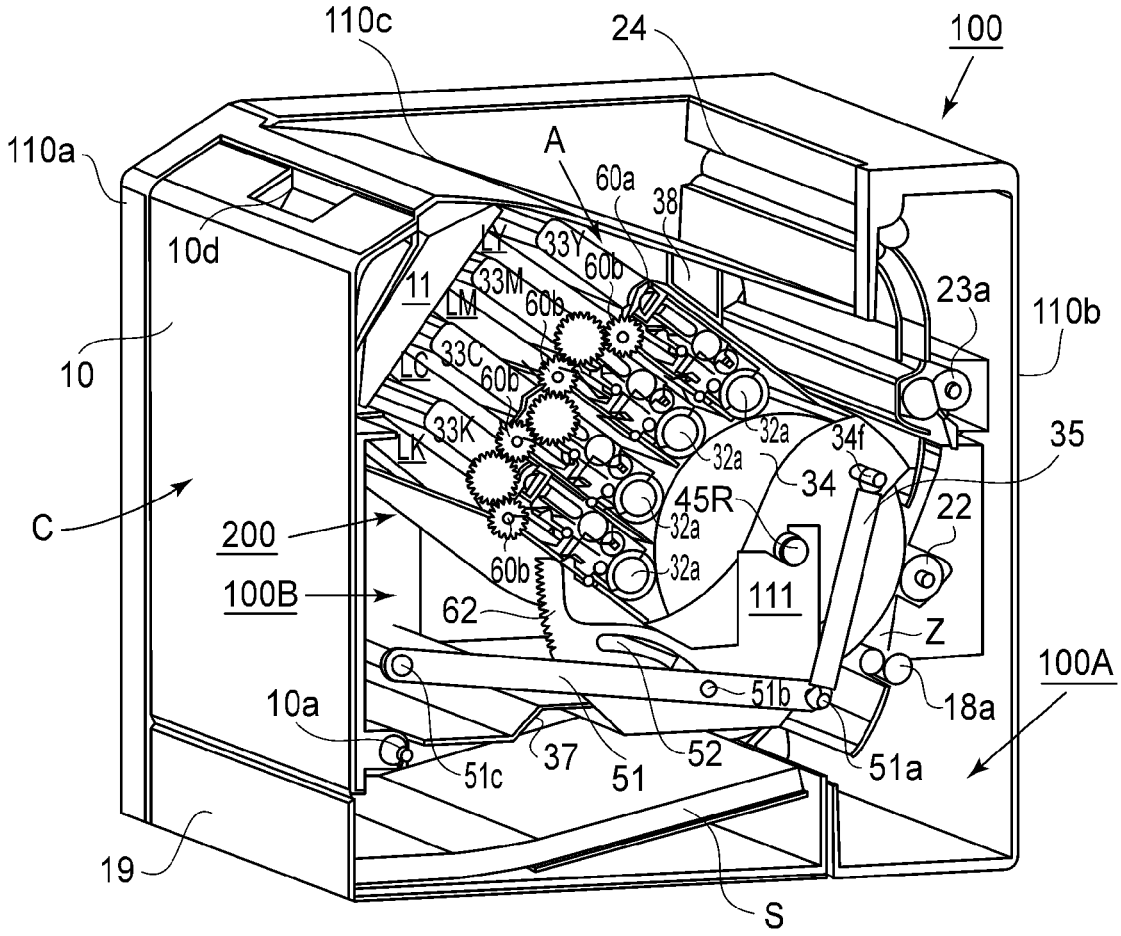
Figure 8B:
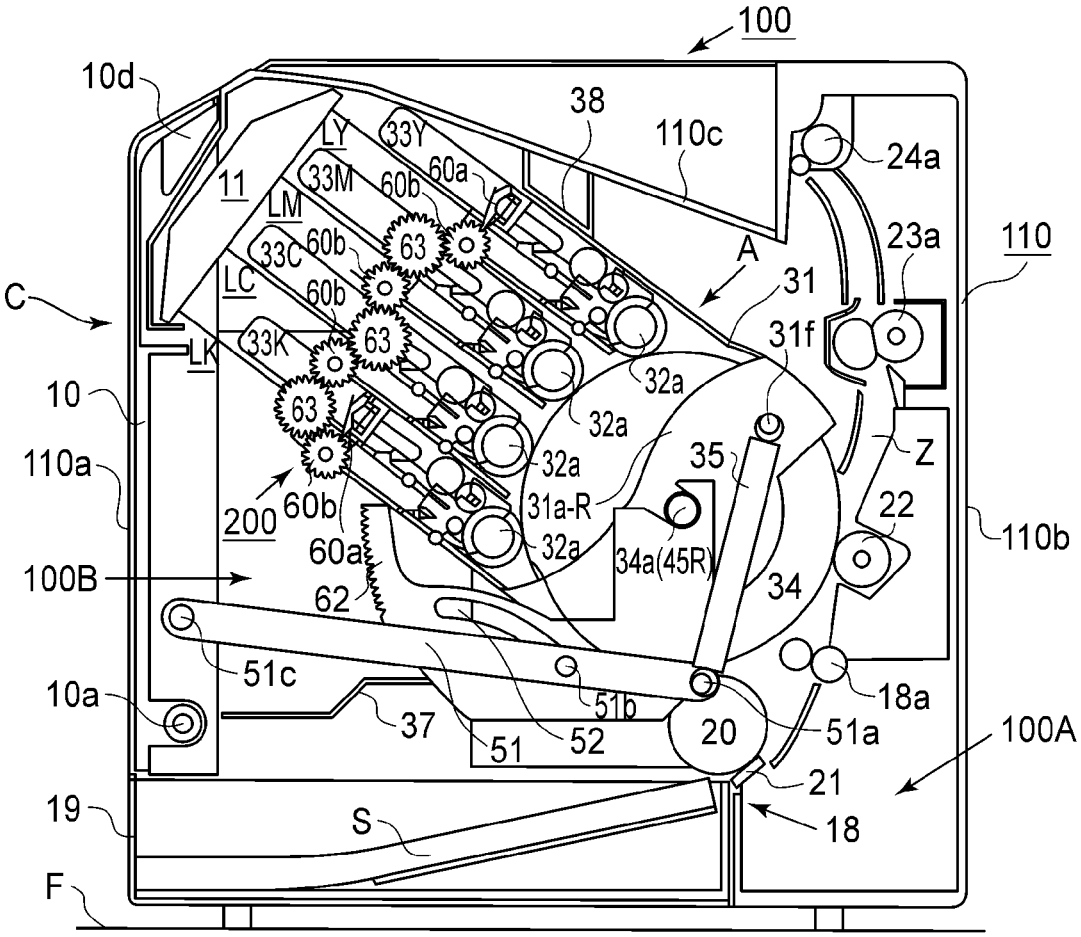

FIG. 8A is a perspective view of the image forming apparatus in the second embodiment, the cover of which is closed, and the image formation unit of which is in its image forming position. FIG. 8B is a vertical sectional view of the image forming apparatus in the second embodiment, the cover of which is closed, and the image formation unit of which is in its image forming position.

Figure 9A:
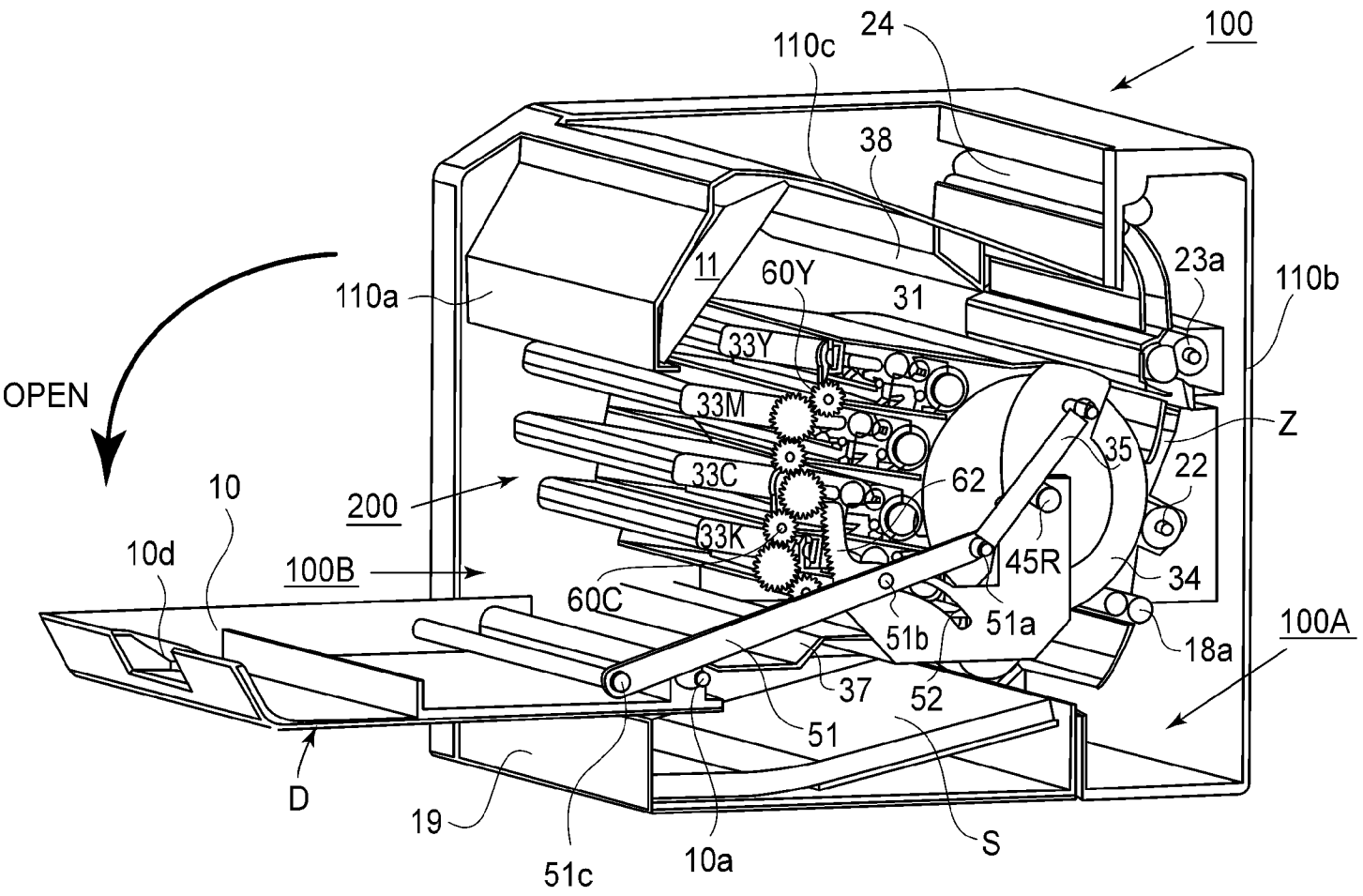
Figure 9B:
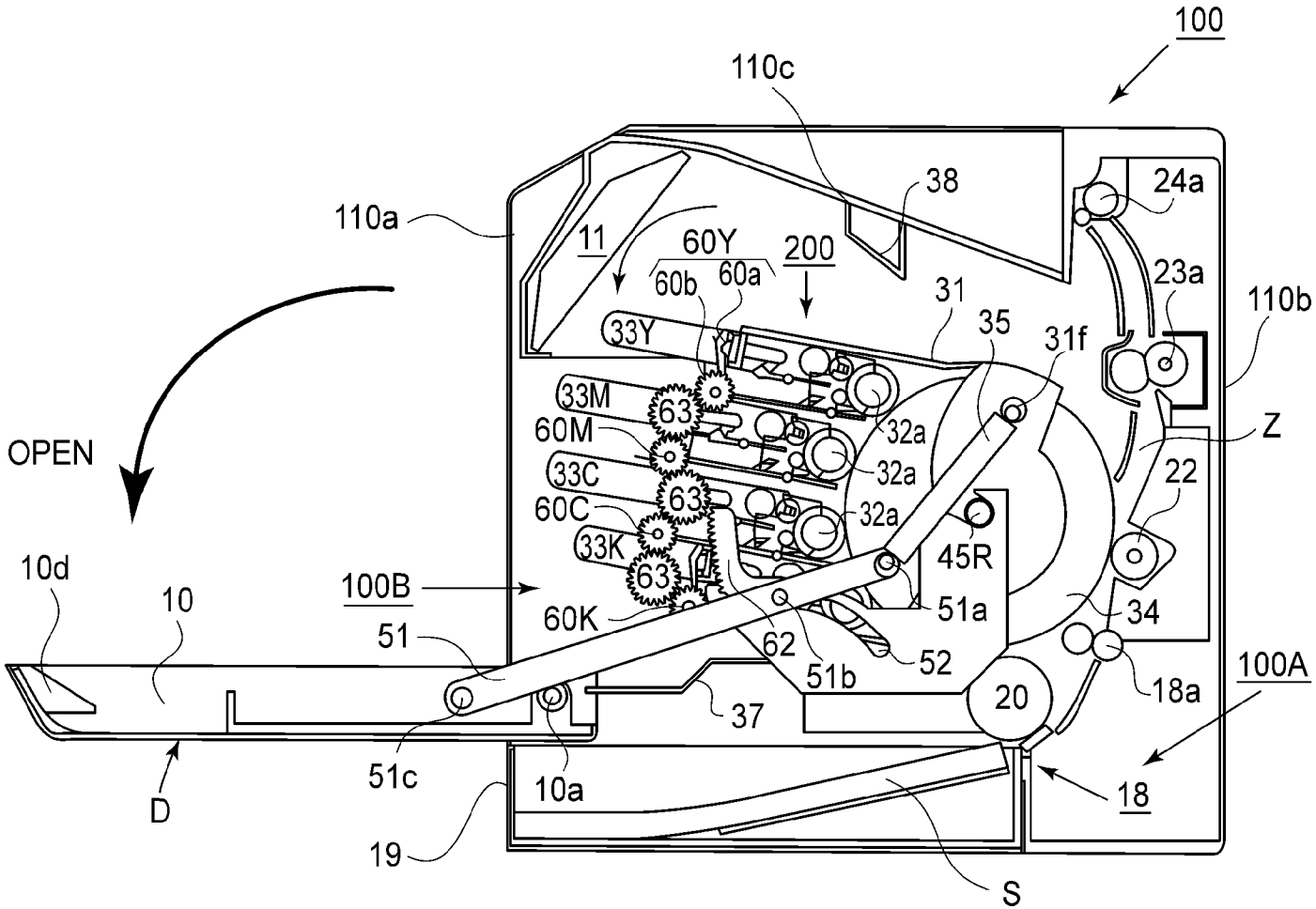

FIG. 9A is a perspective view of the image forming apparatus in the second embodiment, the cover of which is closed, and the image formation unit of which is being mounted into the main assembly of the image forming apparatus. FIG. 9B is a vertical sectional view of the image forming apparatus in the second embodiment, the cover of which is closed, and the image formation unit of which is being mounted into the main assembly of the image forming apparatus.

Figure 10A:
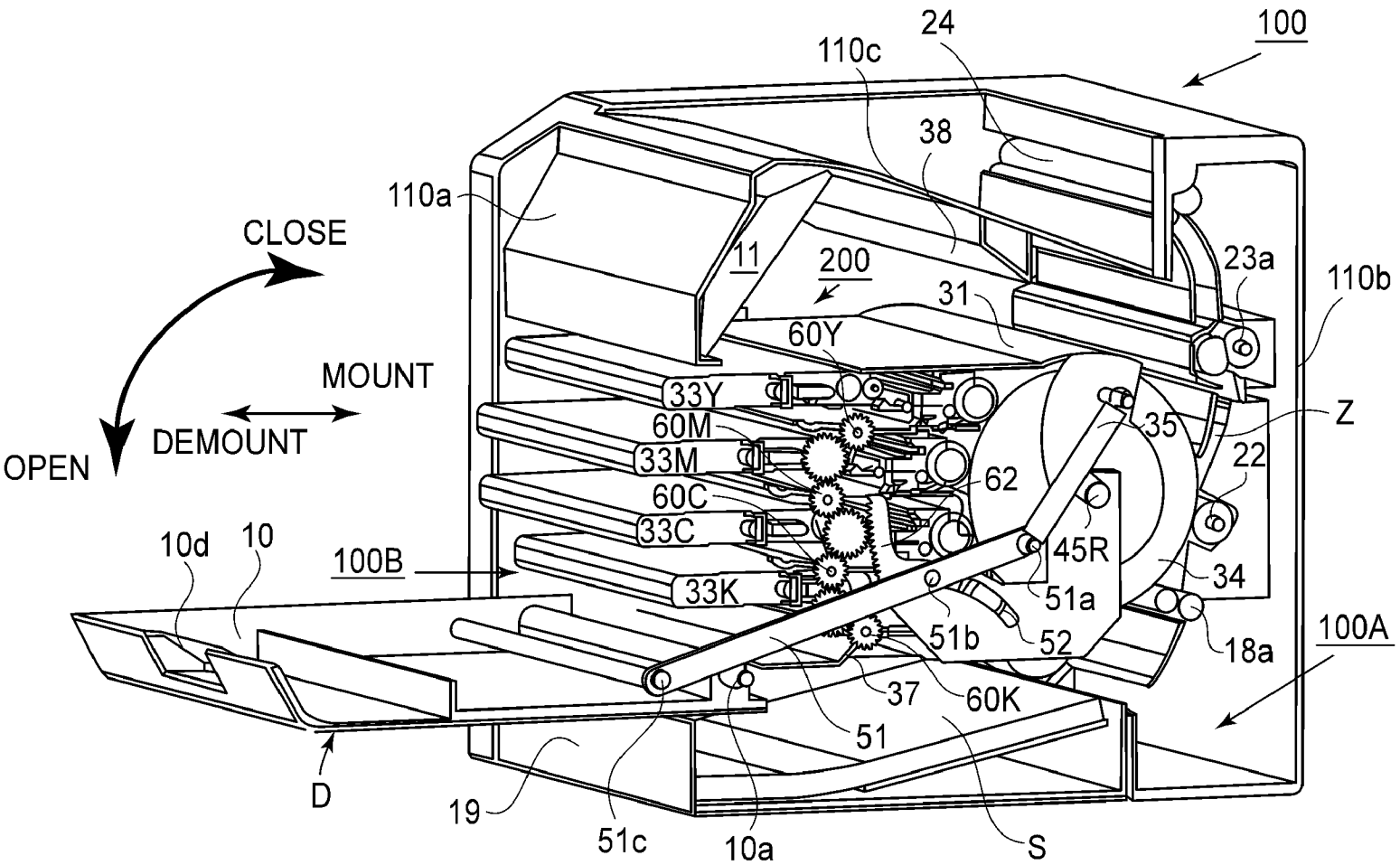
Figure 10B:
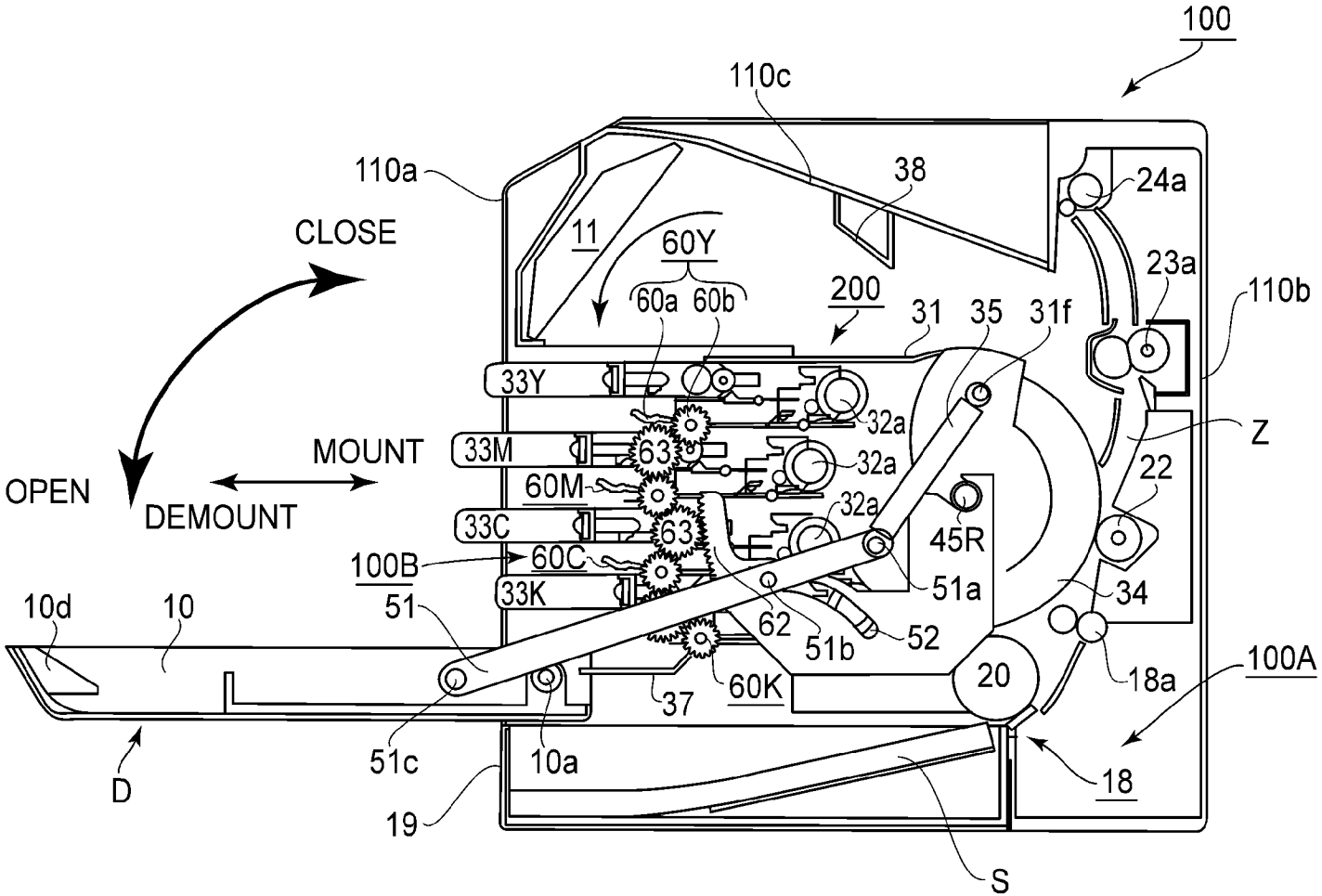

FIG. 10A is a perspective view of the image forming apparatus in the second embodiment, the cover of which is open, and the image formation unit of which is in the position for allowing cartridges to be mounted into, or removed from, the main assembly of the image forming apparatus. FIG. 10B is a vertical sectional view of the image forming apparatus in the second embodiment, the cover of which is open, and the image formation unit of which is in the position for allowing cartridges to be mounted into, or removed from, the main assembly of the image forming apparatus.

Figure 11A:
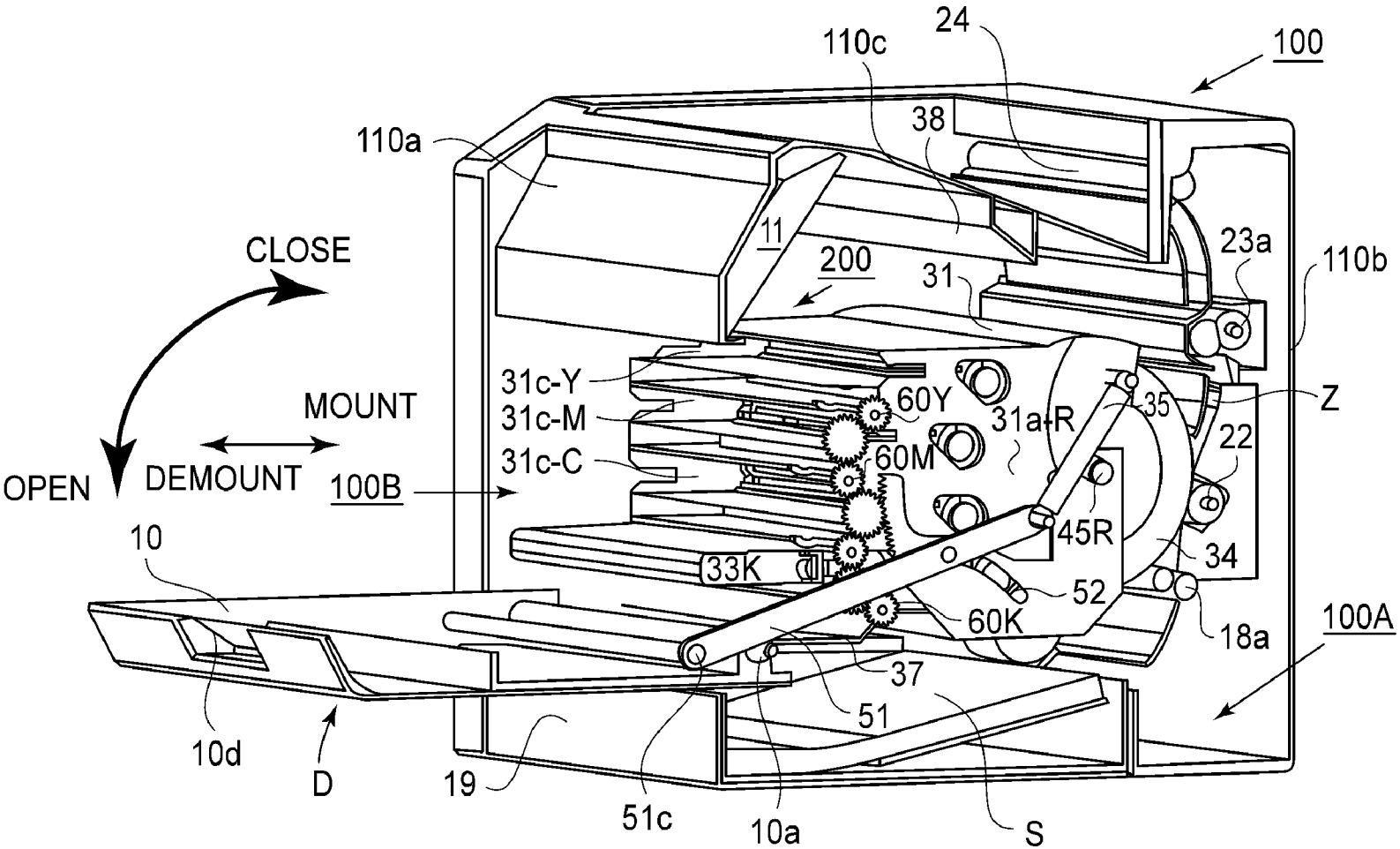
Figure 11B:
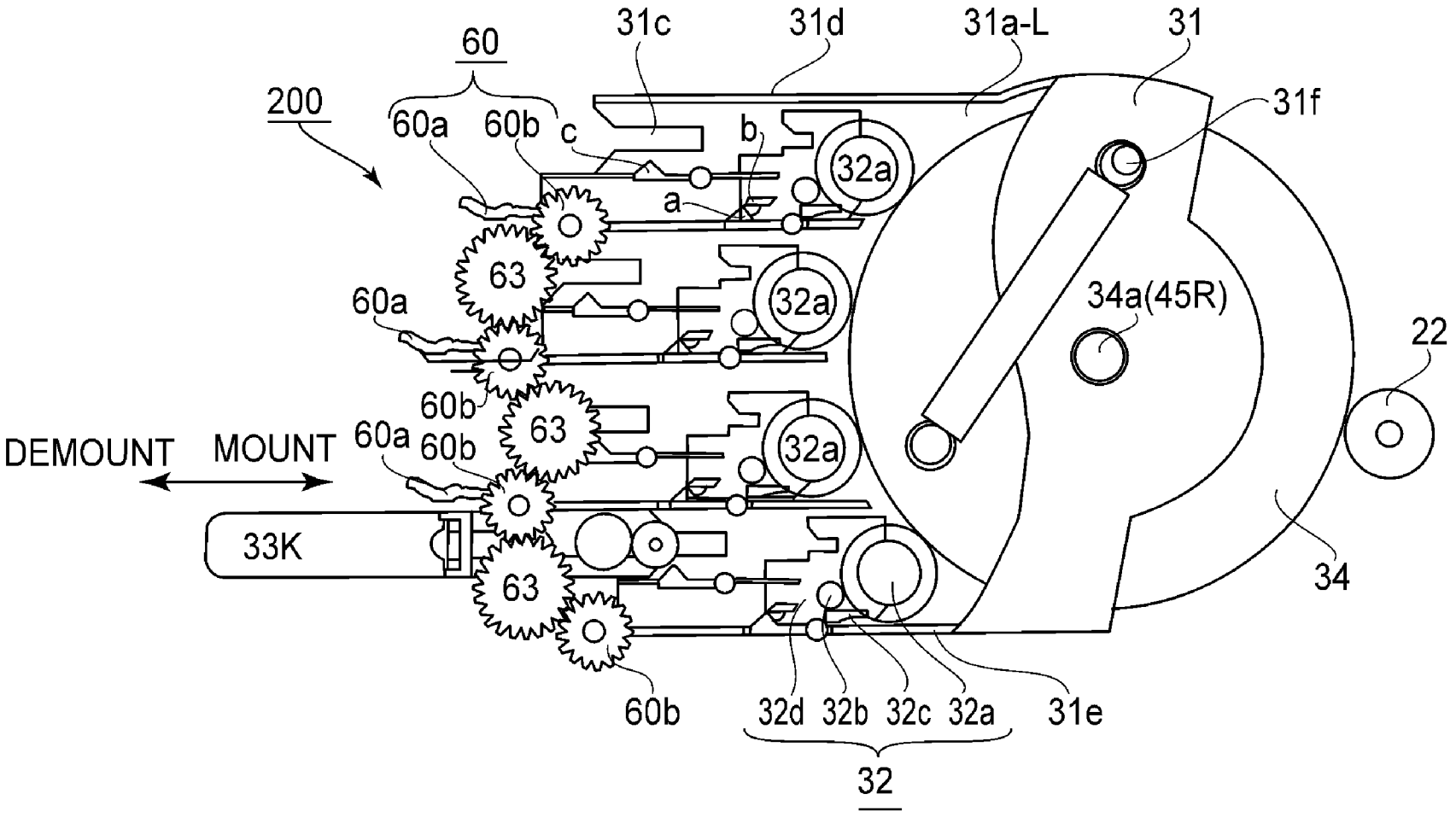

FIG. 11A is a perspective view of the image forming apparatus in the second embodiment of the present invention, the image formation unit of which is in the position for allowing cartridges to be mounted into, or removed from, the main assembly, and the three development cartridges for which have been removed. FIG. 11B is an enlargement of a part of FIG. 11A.

Figure 12A:
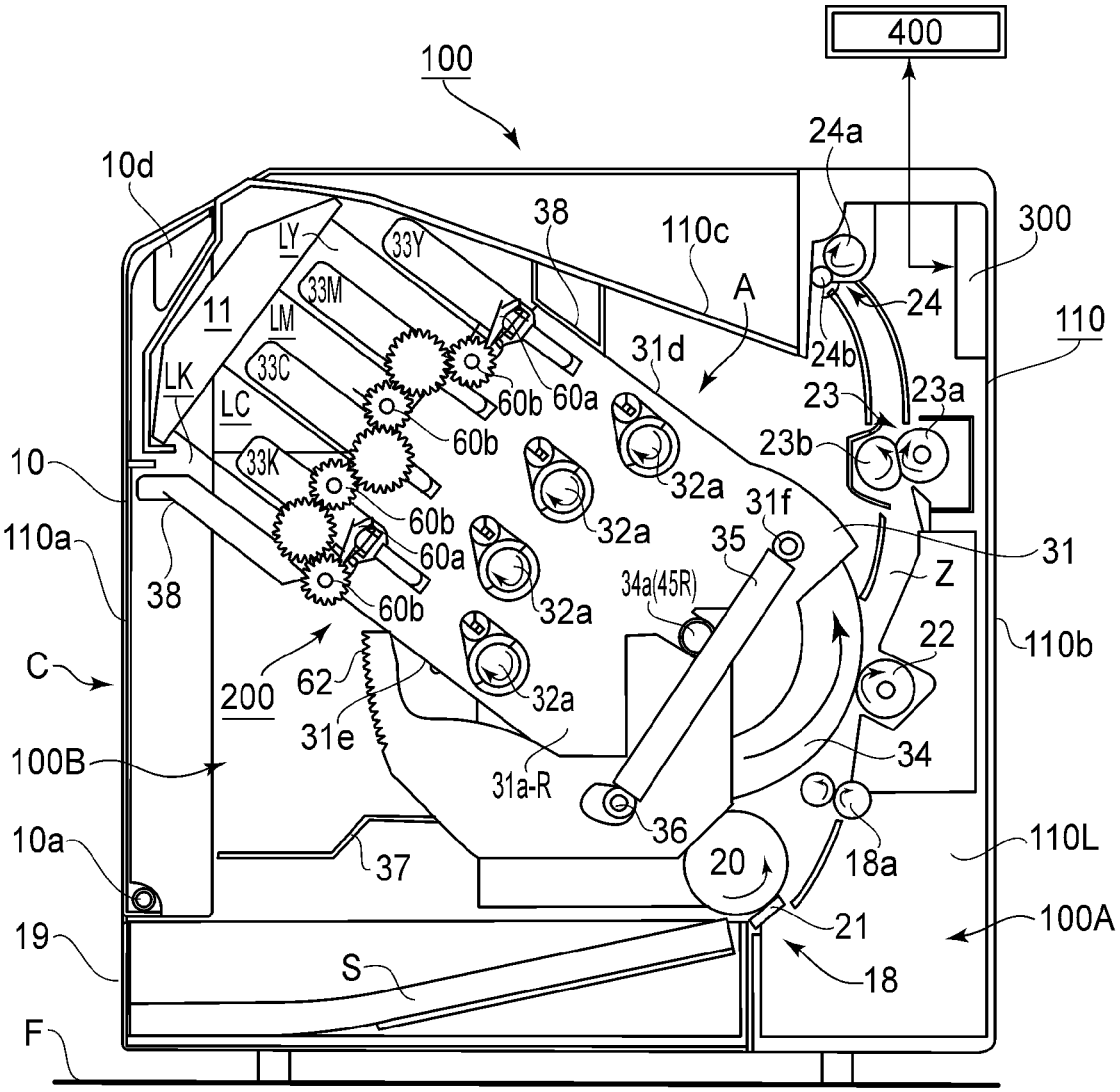
Figure 12B:
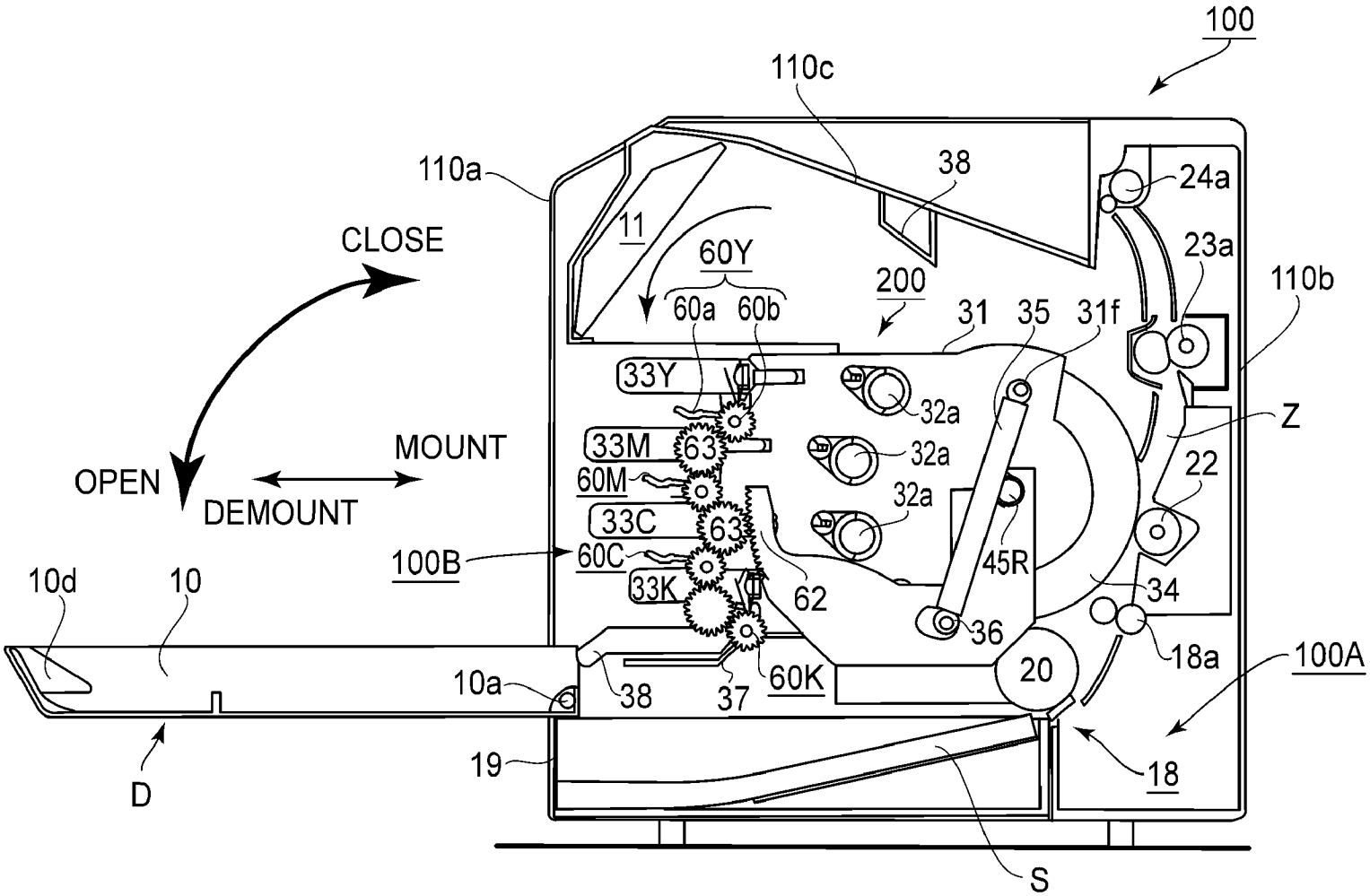

FIG. 12A, is a schematic vertical sectional view of the image forming apparatus in the third embodiment of the present invention. FIG. 12B is a schematic vertical sectional view of the image forming apparatus in the third embodiment, the cover of which is fully open, and the image formation unit of which is in the position for allowing cartridges to be mounted into, or removed from, the main assembly of the image forming apparatus.

DETAILED DESCRIPTION OF THE PREFERRED EMBODIMENTS

Hereinafter, the preferred embodiments of the present invention will be described in detail with reference to the appended drawings. However, the measurements, materials, and shapes of the structural components of image forming apparatuses in the following preferred embodiments, and their positional relationships, are not intended to limit the present invention in scope unless specifically noted.

Embodiment 1

<General Structure of Electrophotographic Color Image Forming Apparatus>

FIG. 1A is an external perspective view of an electrophotographic color image forming apparatus 100 (which hereafter will be referred to simply as image forming apparatus 100, or apparatus 100) in this embodiment of the present invention, and FIG. 1B is a schematic vertical sectional view of the right-hand portion of the image forming apparatus 100 shown in FIG. 1A. The apparatus 100 is a full-color laser beam printer which uses an electrophotographic process. It uses four color toners. More specifically, the apparatus 100 forms a full-color image on a sheet S of recording medium (paper) in response to electric signals inputted into its control circuit 300 from an external host apparatus 400, such as a personal computer, an image reader, a remote facsimile apparatus, etc.

In the following descriptions of the preferred embodiments of the present invention, the front (front side) of the apparatus 100 means the side of the apparatus, from which a sheet feeder cassette 19, in which multiple sheets S of recording medium are stored in layers, can be pulled out of the main assembly of the apparatus 100. The rear (rear side) of the apparatus 100 means the opposite side from the front side. The top side of the apparatus 100 is where a delivery tray 110*c* is located. The frontward direction means the frontward direction relative to the rear of the apparatus 100, whereas the rearward direction means the direction opposite to the frontward direction. The left and right of the apparatus 100 are the left and right, respectively, of the apparatus 100 as the apparatus 100 is seen from the front side of the apparatus 100. The leftward direction of the apparatus 100 means the leftward direction as seen from the front side of the apparatus 100, whereas the rightward direction means the opposite direction from the leftward direction. Further, the apparatus main assembly 100A means what remains after the removal of the cartridges and image formation unit from the apparatus 100.

The apparatus 100 is to be mounted on a roughly horizontal surface F, for example, the surface of a holder dedicated to the apparatus 100, surface of an ordinary desk, surface of a floor, etc. The apparatus main assembly 100A employs an image formation unit 200, which is mounted in the apparatus main assembly 100A. Part (a) of FIG. 2 is an enlargement of the image formation unit portion of the apparatus 100 shown in FIG. 1A. The unit 200 has multiple (four, in this embodiment) cartridge chambers 31*c*, in which four development cartridges 33 (four development cartridges, more specifically, development cartridges 33Y, 33M, 33C, and 33K, in this embodiment) are removably mountable, one for one. Further, the unit 200 has an intermediary transferring member 34, electrophotographic photosensitive drums 32*a* (which hereafter will be referred to simply as drum 32*a*), charge rollers 32*b* (processing means), and cleaning blades 32*c* (processing means). The apparatus 100 forms a color image on a sheet S of recording medium, with the use of multiple cartridges 33 which are removably mountable in the apparatus main assembly 100A (unit 200). The structure of the unit 200 will be described later in detail.

The cartridges 33 in this embodiment are the same in structure, although they are different in the color of the toner they store. However, they do not need to be the same in structure. For example, the developer storage portion of a cartridge 33K, which stores black developer, may be made greater in the capacity than those of cartridges 33Y, 33M, and 33C, which store yellow, magenta, and cyan developers, one for one, other than the black one. Incidentally, this embodiment, and the following ones, will be described referring to a development cartridge as an example of a cartridge. However, the embodiments are not intended to limit the present invention in scope. For example, in this embodiment, the drum 32*a*, roller 32*b*, and blade 32*c*, are attached to the unit 200. However, they may be attached to the cartridge 33. In a case where a cartridge shell, drum 32*a*, roller 32*b*, and blade 32*c* are structured so that the drum 32*a*, roller 32*b*, and blade 32*c* are attached to the cartridge shell, the cartridge will be referred to as a process cartridge instead of a development cartridge, because the roller 32*b*, development roller 33*b*, and blade 32*c*, which are processing means, and the drum 32*a*, are integrally disposed in the cartridge shell which is removably mountable in the apparatus main assembly 100A. The unit 32 has the drum 32*a*. It has also: the charge roller 32*b*, which is a processing means for processing the drum 32*a*; and a cleaning blade 32*c* for removing the developer remaining on the peripheral surface of the drum 32*a*. The drum 32*a*, roller 32*b*, and blade 32*c* are attached to the case 32*d* of the unit 32 in such a manner that preset positional relationships are maintained among them. The unit 32 is attached to the unit 200. Each cartridge 33 has a developing device case 33*a* and a development roller 33*b*. The development roller 33*b* is at one end of the case 33*a*, and supplies the drum 32*a* with developer. That is, the roller 33*b* develops the electrostatic latent image on the drum 32*a*, into a visible image, that is, an image formed of developer. Further, the cartridge 33 has: a developer holding portion 33*c*, as developer storage, for storing the developer to be used for the development of the electrostatic latent image; and a supply roller 33*d* for supplying the roller 33*b* with the developer from the developer holding portion 33*c*.

The developing device 33*c* of the first cartridge 33Y contains yellow (Y) developer. It is for forming a visible image of yellow developer (which hereafter will be referred to simply as yellow developer image), on the peripheral surface of the drum 32*a*. The developing device 33*c* of the second cartridge 33M contains magenta (M) developer. It is for forming a visible image of magenta developer (which hereafter will be referred to simply as magenta developer image), on the peripheral surface of the drum 32*a*. The developing device 33*c* of the third cartridge 33C contains cyan (C) developer. It is for forming a visible image of cyan developer (which hereafter will be referred to simply as cyan developer image), on the peripheral surface of the drum 32*a*. The developing device 33*c* of the fourth cartridge 33K contains black (K) developer. It is for forming a visible image of black developer (which hereafter will be referred to simply as black developer image), on the peripheral surface of the drum 32*a*. The transferring member 34 in this embodiment is a cylindrical drum, which is rotatable about its rotational axis 34*a*. It is horizontally supported so that its axial line is parallel to the leftward or rightward direction. The cartridges 33Y, 33M, 33C, and 33K are on the front side of the transferring member 34, and are stacked in the listed order so that the cartridge 33Y is the topmost one and the cartridge 33K is the bottommost one. They are slightly tilted relative to the apparatus placement surface F at such an angle that the developers in the cartridges 33Y, 33M, 33C, and 33K slide downward toward the supply rollers 33*d*. That is, they are in such an attitude that the developers in their developer storage portion 33*c* are made to flow by their own weight toward the rollers 33*b* and 33*d* in the developer storage portions 33*c*, ensuring that the developers in the storage portions 32*c* will be used up.

In the case of the apparatus 100 in this embodiment, the first cartridge 33Y is placed in the uppermost cartridge chamber, and the second cartridge 33M is placed in the cartridge chamber which is immediately below the uppermost cartridge chamber. The third cartridge 33C is placed in the cartridge chamber which is immediately below the cartridge chamber for the second cartridge 33M, and the fourth cartridge 33K is placed in the bottommost cartridge chamber.

The roller 33*b* of each cartridge 33 may be placed in contact with the peripheral surface of the drum 32*a* (developing method of contact type) as shown in (b) of FIG. 2, or may be positioned so that a preset minute gap $\alpha$ (preset distance) is present between the roller 33*b* and drum 32*a* (developing method of noncontact type), as shown in (c) of FIG. 2. In the case where the roller 33*b* is positioned as shown in (c) of FIG. 2, the left and right end portions of the roller 33*b* are fitted with a pair of spacer 33*s*, one for one, so that the preset amount of gap $\alpha$ is maintained between the roller 33*b* and drum 32*a*.

The image forming portion of the apparatus 100 in this embodiment is structured as shown in (c) of FIG. 2. The apparatus main assembly 100A is provided with a laser scanner unit 11 as an exposing apparatus. The laser scanner unit 11 is in the top front portion of the apparatus main assembly 100A, and is on the front side of the cartridges 33. More specifically, this unit 11 is in the apparatus main assembly 100A, and is between the front portion 110*a* of the main frame 110 of the apparatus main assembly 100A, and the cartridges 33. The unit 11 has a laser diode, a polygonal mirror, an F-θ lens, a deflection mirror, etc. The unit 11 exposes (scans) the peripheral surface of the drum 32*a* in each cartridge 33 by outputting a beam of laser light L (Y, M, C, and K) while modulating the beam of laser light L with the information of the monochromatic images (Y, M, C, and K), which is inputted into the control circuit 300 from the external host apparatus 400. That is, the unit 11 projects a beam of light (laser light) upon each drum 32*a* while modulating the beam of light with the information of the image to be formed. As a result, an electrostatic latent image, which reflects the information of the image to be formed is effected on each drum 32*a*.

There is a sheet feeder unit 18 below the unit 200. The unit 18 has: a sheet feeder cassette 19 in which sheets S of recording medium (which hereafter may be referred to simply as recording sheets S) are stored in layers; a sheet conveyance roller 20; a separation pad 21; etc. The cassette 19 is removably mountable in the apparatus main assembly 100A from the front side of the apparatus main assembly 100A (front loading). Further, there is a recording medium conveyance passage Z between the transferring member 34 and the rear portion 110*b* of the main frame 110. The passage Z extends from the roller 20 to the top rear portion of the apparatus main assembly 100A. Further, there are a pair of registration rollers 18*a*, a second transfer roller 22, a fixing apparatus 23, and a pair of discharge rollers 24, listing from the bottom side of the passage Z. The fixing apparatus 23 has a fixation film unit 23*a* and a pressure roller 23*b*. One of the pair of discharge rollers 24 is a discharge roller 24*a* and the other is a discharge roller 24*b*. A part of the top wall of the apparatus main assembly 100A makes up the delivery tray 110*c*. The apparatus main assembly 100A is provided with a maintenance cover 10, which makes up a part of the front wall of the apparatus main assembly 100A. The cover 10 can be opened or closed. It exposes or covers a cartridge entrance (removal) opening with which the front side of the apparatus main assembly 100A is provided. The cartridge entrance opening 100B is the opening through which the cartridges 33 are mounted into, or removed from, the development cartridge chambers 31*c* of the unit 200 when the unit 200 is in the preset position into which the unit 200 is mounted, or from which the unit 200 is removed.

When the apparatus 100 is in the state shown in FIG. 1B, the driving force input portion (unshown) of the transferring member 34 of the unit 200 is in connection with the driving force output portion (unshown) of the apparatus main assembly 100A. Further, the driving force input portion (unshown) of the unit 32, and the driving force input portion (unshown) of each cartridge 33, are in connection with the driving force output portion (unshown) of the apparatus main assembly 100A. Further, the electrical contacts (unshown) of the unit 32 and the electrical contacts (unshown) of each cartridge 33, are in connection with the electric power supply system (unshown) of the apparatus main assembly 100A.

The full-color image forming operation of the apparatus 100 is as follows. The drum 32*a* is rotated at a preset speed in the clockwise direction indicated by an arrow mark in (a) of FIG. 2. As the drum 32*a* is rotated, the roller 32*b* is rotated by the rotation of the drum 32*a*. The transferring member 34 is rotated in the counterclockwise direction indicated by an arrow mark in (a) of FIG. 2, at a speed which corresponds to the speed of the drum 32*a*. Further, the rollers 33*b* and 33*d* of each cartridge 33 are rotated in the counterclockwise direction indicated by an arrow mark in (a) of FIG. 2 at a preset speed. The unit 11 also is driven. In synchronism with the driving of these components, a preset charge bias is applied to the roller 32*b* with a preset timing. As a result, the peripheral surface of the drum 32*a* is uniformly charged to preset polarity and potential level by the roller 32*b*. The unit 11 exposes (scans) the charged portion of the peripheral surface of the drum 32*a* with the beam of laser light L it emits while modulating the beam with the image signals for forming a monochromatic image of color Y, M, C, or K. As a result, an electrostatic latent image corresponding to color Y, M, C, or K is formed on the peripheral surface of the drum 32*a*. The electrostatic latent image on the peripheral surface of the drum 32*a* is developed by the roller 33*b* into a visible image, that is, an image formed of developer. To the roller 32*b*, a preset development bias is applied with preset control timing.

Through the above described electrophotographic image formation process, a yellow developer image, which corresponds to the yellow component of the full-color image to be formed is formed on the drum 32*a* which the cartridge 33Y faces. Then, this developer image is transferred (first transfer) onto the intermediary transferring member 34, in the first transfer nip, which is the interface between the drum 32*a* and transferring member 34. On the drum 32*a* which the cartridge 33M faces, a magenta developer image, which corresponds to the magenta component of the full-color image, is formed. This developer image is transferred (first transfer) onto the intermediary transferring member 34 in such a manner that it is layered upon the yellow developer image on the intermediary transferring member 34, in the first transfer nip, which is the interface between the drum 32*a* and transferring member 34.

On the drum 32*a* which the cartridge 33C faces, a cyan developer image, which corresponds to the cyan component of the full-color image, is formed. This developer image is transferred (first transfer) onto the transferring member 34 in such a manner that it is layered upon the layered combination of the yellow developer image and magenta developer image on the transferring member 34, in the first transfer nip, which is the interface between the drum 32*a* and intermediary transferring member 34. On the drum 32*a* which the cartridge 33K faces, a black developer image, which corresponds to the black component of the full-color image, is formed. This developer image is transferred (first transfer) onto the transferring member 34 in such a manner that it is layered upon the layered combination of the yellow, magenta, and cyan developer images on the intermediary transferring member 34, in the first transfer nip, which is the interface between the drum 32*a* and transferring member 34. Consequently, an unfixed full-color developer image is synthetically formed on the transferring member 34, of the yellow, magenta, cyan, and black developer images. Incidentally, the order in which these monochromatic developer images are transferred in layers onto the intermediary transferring member 34 does not need to be limited to the above described one. The transfer residual developer on the drum 32*a*, that is, the developers remaining on the drum 32*a* after the first transfer of the developer images, is removed by the blade 32*c*.

Further, the roller 20 is driven with a preset control timing, whereby the sheets S of recording medium in the cassette 19 are fed into the apparatus main assembly 100A while being separated one by one by the coordination of the roller 20 and pad 21. Then, each recording sheet S is introduced into the second transfer nip, which is the interface between the transferring member 34 and second transfer roller 22, with a preset timing, by a pair of rollers 18*a*. To the roller 22, the second transfer bias, which is preset in potential level and is opposite in polarity from the developer, is applied with a preset control timing, whereby the full-color developer image made up of the layered combination of the four monochromatic developer images on the transferring member 34 is transferred (second transfer) onto the recording sheet S, as if it is peeled away from the transferring member 34, while the recording sheet S is conveyed through the second transfer nip while remaining pinched by the roller 22 and transferring member 34. After the recording sheet S is moved through the second transfer nip, it is separated from the surface of the transferring member 34, and then, is introduced into the fixing apparatus 23. In the fixing apparatus, heat and pressure are applied to the recording sheet S and the unfixed developer image thereon. As a result, the four monochromatic developer images, different in color, on the recording sheet S are fixed to the recording sheet S while being mixed. Then, the recording sheet S is discharged from the fixing apparatus 23, and then, is discharged, as a full-color print, onto the delivery tray 110*c* by the pair of rollers 24.

In this embodiment, the second transfer residual toner, that is, the toner remaining on the peripheral surface of the transferring member 34 after the separation of the recording sheet S from the transferring member 34, electrostatically adheres to the peripheral surface of the drum 32*a* in the primary transfer nip of the unit 32 which holds the cartridge 33Y, for example. Then, it is removed by the blade 32*c*. The transferring member 34 is rotatable, and in the form of a drum. Onto the transferring member 34, multiple monochromatic developer images, different in color, formed on multiple drums 32*a*, one for one, are transferred in layers. Then, the multiple monochromatic developer images, different in color, on the transferring member 34 are transferred all at once onto the recording sheet S. Consequently, a color image is formed on the recording sheet S. Incidentally, when the apparatus 100 is used to form a monochromatic (black) image, only a monochromatic (black) developer image is formed on the drum 32*a*, and then, is transferred onto the transferring member 34 from the drum 32*a*. Then, the monochromatic (black) developer image is transferred from the transferring member 34 onto the recording sheet S, to form a monochromatic (black) image on the recording sheet S. The time of the completion of the formation of the finished image on the recording sheet S is when the recording sheet S comes out of the fixing apparatus 23.

Further, when the apparatus 100 is operated in the black mode, only the combination of the cartridge 33K and unit 32, which is for forming black images, is used. In this embodiment, the second transfer roller 22 is movable by the second transfer roller moving mechanism (unshown) so that it can be kept in the first position where it forms the second transfer nip by being placed in contact with the transferring member 34, and the second position where it remains separated from the transferring member 34. More specifically, when the apparatus 100 is an image forming operation, the second transfer roller 22 is kept in the first position, whereas when the apparatus 100 is not in an image forming operation, the roller 22 is kept in the second position. However, the apparatus 100 may be structured so that the roller 22 remains in contact with the transferring member 34 whether or not the apparatus 100 is in an image forming operation.

<Image Formation Unit>

Next referring primarily to FIG. 1A, part (a) of FIG. 2, part (a) of FIG. 3, and FIG. 4, the structure of the unit 200 will be described. Part (a) of FIG. 3 is an external perspective view of the unit 200. Part (b) of FIG. 3 is a perspective view of the roughly right-hand half of the unit 200 when the unit 200 is holding no cartridges 33. Part (a) of FIG. 4 is a partially broken perspective view of the unit 200. Part (b) of FIG. 4 is a perspective view of the portion of the unit 200, which is for precisely positioning the cartridge 33 and unit 32 relative to each other.

The unit 200 has a frame 31, which enables the unit 200 to be mounted into, or removed from, the main frame 110 of the apparatus main assembly 100A. The frame 31 has an intermediary transfer member supporting portions 31*a* (31*a*-L and 31*a*-R) which rotatably support the transferring member 34. The transferring member 34 is supported by the left and right portions 31*a*-L and 31*a*-R, respectively, of the frame 31. More specifically, the left and right portions 31*a*-L and 31*a*-R of the frame 31 are fitted with a pair of bearings, one for one, and the left and right end portions of the center shaft 34*a* (rotational axis) of the transferring member 34 are supported by the pair of bearings, one for one, so that the transferring member 34 is rotatable. The left and right portions 31*a*-L and 31*a*-R (which hereafter may be referred to as left and right plates) of the frame 31 have left (unshown) and right shafts 45L and 45R, which are integral with the left and right plates 31*a*-L and 31*a*-R, respectively. The left and right shafts 45L and 45R are coaxial with the center shaft 34*a* of the transfer member supporting portion 31*a*. Further, the unit 200 has a pair of gears G5. The case 32*d* of each unit 32 is connected to this frame 31. While the unit 32 is supported by the frame 31, an elastic pawl a, with which the frame 31 is provided, remains engaged with a projection b, with which the unit 32 is provided. Therefore, the unit 32 is kept pressed toward the transferring member 34 by the resiliency of the elastic pawl a. Therefore, the drum 32*a* is kept pressed upon the transferring member 34 by a preset amount of force. Further, the frame 31 has multiple cartridge chambers 31*c* in which the cartridges 33 are removably mountable, one for one. In this embodiment, the multiple cartridge chambers 31*c* are development cartridge chambers (developing device connecting unit which holds development cartridge 33), and are independent from each other, making it possible for each cartridge 33 to be independently mounted into, or removed from, the corresponding cartridge chamber, from the other.

The cover 10 is connected by its bottom edge portion, to the apparatus main assembly 100A with the presence of a shaft 10*a*, as a hinge, in such a manner that it can be rotationally movable relative to the apparatus main assembly 100A. It is enabled to be placed in the position C where it keeps the front opening 100B of the apparatus main assembly 100A closed, and the position D where it keeps the front opening 100B exposed. That is, the cover 10 is a part of the front wall of the apparatus main assembly 100A, and is rotatable to expose or cover the front opening 100B of the apparatus main assembly 100A. The front opening 100B is the opening through which the cartridges 33 are mounted into, or removed from, the cartridge chambers 31*c* of the unit 200 when the unit 200 is in the cartridge mounting-and-removing position B (FIG. 6B). Referring to FIGS. 1A and 1B, normally, the cover 10 remains closed, keeping thereby the front opening 100B covered. The right plate 31*a*-R of the frame 31 is provided with a projection 31*f*, which is on the outward surface of the right plate 31*a*-R. There is a spring 35 (elastic member) between the projection 31*f* and a projection (unshown) which is on the inward surface of the right wall 110R of the frame 110, remaining stretched by the two projections. When the cover 10 is in the position where it keeps the opening 100B closed (as shown in FIGS. 5A and 5B), the spring 35 is on the rear side of the shaft 45R (dead center) of the unit 200. Therefore, the unit 200 remains pressed in the direction to rotate clockwise about the shafts 45L and 45R, by the tension of the springs 35. Thus, the frame 31 is kept pressed by the unit 200 so that it rotates about the shafts 45L and 45R in the clockwise direction in FIG. 1B. Thus, the top surface 31*d* of the frame 31 is kept pressed upon a stay 38 (frame positioning portion of apparatus main assembly 100A) of the apparatus main assembly 100A. Therefore, the frame 31 remains correctly positioned relative to the apparatus main assembly 100A. That is, the unit 200 remains placed in the transfer position A (which enable apparatus to form images) (FIGS. 5A and 5B) where the developer images transferred onto the transferring member 34 from the drums 32*a* are transferred onto the recording sheet S. In other words, the unit 200 is locked into, and kept locked in, the image forming position A by the coordination among the cover 10, spring 35, and stay 38 (FIG. 1B). The cover 10, spring 35, and stay 38 make up a locking mechanism (first locking mechanism).

This embodiment makes it possible to be precisely position the unit 200 relative to the apparatus main assembly 100A. Incidentally, the structure of the first locking mechanism does not need to be limited to the above described one. The structural arrangement is optional as long as the same effects as those described above can be realized. Further, when the unit 200 is in the transfer position A, the driving force input portion (unshown) of the transferring member 34 of the unit 200 is in connection to the driving force output portion (unshown) of the apparatus main assembly 100A. Further, the driving force input portion of the unit 32 and the driving force input portion of the cartridge 33 are in connection with the driving force output portion of the apparatus main assembly 100A, which entered the unit 200 from the left side. Further, the electrical contacts of the unit 32 and the electrical contacts of the cartridge 33 are in connection to the electric power supply system of the apparatus main assembly 100A. Thus, the apparatus 100 is ready for an image forming operation (a printing operation). That is, as soon as the apparatus 100 receives an image formation start signal (printing start signal), it can start an image forming operation such as the one described above.

Referring to FIG. 1B, in this embodiment, the unit 11, cartridge 33, drum 32*a*, transferring member 34, and recording medium conveyance passage Z, are positioned so that they align roughly parallel to the apparatus placement surface F. Further, the top portion of the apparatus 100 has the tray 110*c*, and the bottom portion of the apparatus 100 holds the cassette 19. The beams of laser light L (Y, M, C, and K) from the unit 11 are projected upon the drums 32*a* from the rear side of the cartridges 33, one for one. After the monochromatic developer images, different in color, are transferred from the drums 32*a* onto the transferring member 34, they are transferred onto the recording sheet S from the opposite side of the transferring member 34 from the side where the drums 32*a* face the transferring member 34. Also in this embodiment, when the drums 32*a* are correctly in contact with the unit 200, and the cartridges 33 are correctly in the unit 200 (cartridge chambers 31*c*), the unit 200 can be rotationally moved to be placed in the transfer position A (image formation position) or the cartridge mounting-and-dismounting position B. As the unit 200 is rotationally moved from the transfer position A into the cartridge mounting-and-dismounting position B, it becomes possible for the cartridges 33 to be mounted into, or removed from, the unit 200. That is, the unit 200 is made rotatable about its rotational axis so that it is allowed to take the transfer position A or cartridge mounting-and-dismounting position B. The employment of the above described structural arrangement for an image forming apparatus in this embodiment makes it possible to reduce an electrophotographic image forming apparatus (100) in size.

<Method for Replacing Development Cartridge>

As each cartridge (Y, M, C, or K) is used for image formation, the developer in the developing device 33*c* (developer holding portion) is consumed. Thus, the apparatus main assembly 100A is provided with a means (unshown) for detecting the amount of the developer remainder in the cartridge 33. The detected amount of the developer remainder is compared by the control circuit 300 with a threshold value preset for allowing a user to predict the end of the service life of each cartridge (33), or warning a user of the nearness of the end of the service life of the cartridge (33). More specifically, as the abovementioned detected amount of the developer remainder in a given cartridge 33 falls below the threshold value, it is shown on the display 102 of the control portion 101 of the apparatus 100 (FIG. 1A), to inform a user of the remaining amount of the service life of the cartridge 33, or warm the user of the nearness of the end of the service life of the cartridge 33. In other words, it is suggested that the user is to prepare a replacement cartridge (cartridges), or replace the cartridge 33 (cartridges), in order to ensure that the apparatus 100 continues to output images of high quality.

In the case of the apparatus 100 in this embodiment, in order to replace any of the cartridges 33 in the apparatus main assembly 100A, the cover 10 has to be opened to expose the opening 100B. That is, in order to replace any of the cartridges 33, a user is to manually and rotationally move the cover 100 about the shaft 10*a* by placing his or her hand on the handle portion 10*d* of the cover 10, from the position C where the cover 10 keeps the opening 100B covered, to the position D where the cover 10 keeps the opening 100B fully exposed. FIGS. 6A and 6B show the apparatus 100 when the cover 10 is in the position D. As the cover 10 is opened, the driving force outputting portion of the apparatus main assembly 100A is disengaged from the driving force input portion of the transferring member 34 of the unit 200 by a mechanism (unshown) which is moved by the movement of the cover 10, and also, from the driving force input portion of each unit 32 and the driving force input portion of each cartridge 33. Further, the electric power supply system of the apparatus main assembly 100A is disconnected from the electrical contacts of each unit 32 and the electrical contacts of the each cartridge 33. As the cover 10 is moved into the position D, the spring 35 is moved to the front side of the shaft 45R (dead center) of the unit 200. Therefore, the unit 200 is under the force generated by the tension of the spring 35 in the direction to rotate the unit 200 in the counterclockwise direction (FIGS. 6A and 6B) about the shafts 45L and 45R. Thus, after the cover 10 is moved into the position D, even if the user releases the cover 10, it does not occur that the cover 100 automatically rotates backward. The shaft 10*a* is rotatably supported by the left and right walls 110L and 110R of the main frame 110 of the apparatus main assembly 100A; the left and right end portions of the shaft 10*a* are supported by a pair of bearings with which the left and right walls 110L and 110R of the main frame 110 of the apparatus main assembly 100A are fitted, one for one. The shaft 10*a* is an integral part of the cover 10. Therefore, as the cover 10 is rotationally opened or closed, the shaft 10*a* rotationally moves with the cover 10. The left and right end portions of the shaft 10*a* have a pair of cover gears G1, one for one, which are in the form of a fan and are integral parts of the shaft 10*a*. The pair of cover gears G1 are symmetrically positioned relative to the center of the shaft 10*a*, and are the same in rotational phase. The left gear G1 and the aforementioned left gear G5 (attached to unit 200) are indirectly in connection to each other through left idler gears G2, G3, and G4. The right gear G1 and the aforementioned right gear G5 (attached unit 200) are indirectly in connection to each other through right idler gears G2, G3, and G4. The left idler gears G2, G3, and G4 are attached to the left wall 110L of the main frame 110 of the apparatus main assembly 100A, and are freely rotatable. The right idler gears G2, G3, and G4 are attached to the right wall 110L of the main frame 110 of the apparatus main assembly 100A, and are freely rotatable. The provision of these gear trains causes the unit 200 to be rotationally moved by the opening or closing movement of the cover 10. That is, the abovementioned gears G1-G5 make up the mechanism for moving the unit 200 by the movement of the cover 10.

Referring to FIGS. 5A and 5B, when the cover 10 is in the position in which it keeps the opening 100A covered, the angle of the fan-shaped gear G1 is such that the fan-shaped gear G1 is not in engagement with the gear G2. That is, the cover 10 and unit 200 are not in engagement with each other. Thus, regardless of the position of the cover 10, the unit 200 remains correctly positioned relative to the apparatus main assembly 100A by the spring 35, in a preset manner while ensuring that the unit 200 is kept in contact with the stay 38. When the cover 10 is in the position shown in FIGS. 5A and 5B, a user is to manually open the cover 10 by placing his or her hand on the handle portion 10*d* of the cover 10, and to rotationally move the cover 10 to the position D shown in FIGS. 6A and 6B. As the cover 10 is opened by an angle greater than a preset one, the gear G1 becomes meshed with the gear G2. Then, the further rotational opening movement of the cover 10 causes the force applied to the cover 10 by the user to open the cover 10 to be transmitted to the gear G5 through the gears G2, G3, and G4. Thus, the unit 200 is rotationally moved about the left and right shafts 45L and 45R in the counterclockwise direction (as seen from right-hand side of apparatus 100), in the apparatus main assembly 100A. Further, as the cover 10 is opened, the front opening 100B of the apparatus main assembly 100A is exposed. Then, as the cover 10 is fully opened, that is, as the cover 10 is moved into the position D, it is kept in this position by the force generated by the spring 35 in the direction to open the cover 10. Therefore, the opening 100B is fully exposed, and remains fully exposed, as shown in FIGS. 6A and 6B. Further, as the cover 10 is opened, the unit 200 is rotationally moved in the counterclockwise direction by roughly 40°, from the transfer position A (FIGS. 5A and 5B) until it becomes roughly horizontal so that the cartridges 33 become accessible by the user through the opening 100B (FIGS. 6A and 6B). Thereafter, the unit 200 remains roughly parallel to the apparatus placement surface F. That is, as the cover 10 is opened, the unit 200 is moved into the cartridge mounting-and-dismounting position B by the movement of the cover 10. Here, the cartridge mounting-and-dismounting position B is such a position that allows the user to mount any cartridge (33) into the corresponding cartridge chamber, or dismount it.

In this embodiment, a user is to manually and rotationally move the closed cover 10 until the cover 10 becomes fully open. As the cover 10 is moved in the opening direction, the unit 200 is moved from the transfer position A to the cartridge mounting-and-dismounting position B. In other words, all that is necessary to move the unit 200 from the transfer position A to the cartridge mounting-and-dismounting position B is for a user to manually move the cover 10 until the opening 100B becomes fully exposed. Further, the direction in which the cartridges 33 have to be moved to be mounted into, or dismounted from, the unit 200 (apparatus main assembly 100A) is roughly parallel to the apparatus placement surface F. Therefore, they can be replaced without retracting the unit 11. Further, the attitude in which the cartridges 33 have to be kept when they are mounted or dismounted is such that they remain roughly horizontal, or slightly tilted upward (in direction to prevent toner from falling). Therefore, it is possible to prevent developer (toner) from falling into and/or outside the apparatus main assembly 100A when replacing the cartridges 33. Therefore, a user can easily replace the cartridges 33. Further, with the employment of the above-described structural arrangement for the apparatus 100, when the apparatus 100 is in an image forming operation, the cartridges 33 remain tilted at such an angle that the developers (toners) therein are naturally (automatically) supplied to the development rollers. In other words, this structural arrangement makes a toner stirring mechanism unnecessary, making it therefore possible to provide cartridges (33) which are substantially lower in cost than the conventional ones, and also, to use up the developers (toners) therein. That is, when the unit 200 is in the transfer position A, the cartridges 33 (Y, M, C, and K) in the unit 200 are in such an attitude that the developer in the developer holding portion 33*c* of each cartridge 33 is supplied to the corresponding development roller 33*b* by the weight of the developer itself. Further, when the unit 200 is in the cartridge mounting-and-dismounting position B, the cartridges 33 in the unit 200 are in the abovementioned roughly horizontal attitude, that is, such an attitude that the developer in the developer holding portion 33*c* of each cartridge 33 is not supplied to the development roller 33*b* by the weight of the developer itself, or slightly upwardly tilted (such attitude that prevent toner from falling: attitude that developer in developer holding portion 33*c* is likely to be flowed in the opposite direction from development roller 33*b* by weight of developer itself).

Next, the process of moving the unit 200 back into the transfer position A after the cartridge 33 or cartridges 33 are replaced while the unit 200 is kept in the cartridge mounting-and-dismounting position B, will be described. Referring to FIGS. 6A and 6B, each cartridge 33 is to be insert into the corresponding cartridge chamber 31*c* of the unit 200 when the unit 200 is in the cartridge mounting-and-dismounting position B. As the cartridge 33 is mounted into the corresponding cartridge chamber 31*c*, the elastic member c ((a) of FIG. 2) of the cartridge chamber 31*c* engages with the projection d of the cartridge 33, whereby the cartridge 33 is retained in the cartridge chamber 31*c*. After the replacement of the cartridge 33, a user is to rotationally move the cover 10, which is in the opening exposing position D, in the direction to close (cover) the opening 100B. As the cover 100 is rotationally moved in the closing direction, the unit 200 is rotationally moved about the shafts 45L and 45R in the clockwise direction (FIG. 6A) by the movement of the cover 10. At the same time, the force applied to the cover 10 to rotationally move the cover 10 by the user is transmitted to the unit 200 through the gears G1-G5. As the cover 100 is moved in the closing direction by an angle greater than a preset one, the gear G1 becomes disengaged from the gear G2. That is, the cover 10 and unit 200 become disengaged from each other. Thus, the unit 200 is rotationally moved in the clockwise direction about the shafts 45L and 45R by the rotational force applied to the unit 200 by the spring 35, being thereby placed, and kept, in contact with the stay 38. Therefore, the unit 200 remains in the transfer position A thereafter (FIGS. 1A and 1B). Further, while the cover 10 is rotationally moved in the closing direction, from the abovementioned angle beyond which the cover 10 becomes disengaged from the unit 200, to the position in which it completely covers the opening 100B, the driving force outputting portion (unshown) of the apparatus main assembly 100A is engaged with the driving force input portion (unshown) of the transferring member 34, and also, with the driving force input portion (unshown) of the unit 32 and the driving force input portion (unshown) of the cartridge 33, by the abovementioned mechanism (unshown) which is moved by the movement of the cover 10. Further, the electrical contacts of the apparatus main assembly 100A are connected to the electrical contacts of the unit 32 and cartridge 33. Thereafter, the cover 10 remains fully closed. Through the above-described process, the apparatus 100 is put back into the state shown in FIG. 5B, being readied for image formation. Incidentally, the gears G1 and G5 may be integral with, or independent from, the cover 10 and frame 31, respectively. Further, the apparatus main assembly 100A may be structured so that the unit 200 is directly moved by the movement of the cover 10 with the employment of a combination of a rack and a pinion gear, instead of the above-described mechanism. Although this embodiment was described with reference to the development cartridge 33 as a cartridge to be replaced, this embodiment is also applicable to an image forming apparatus, whose cartridge or cartridges to be replaced are a process cartridge or process cartridges, that is, a cartridge or cartridges made up of the photosensitive unit 32 and development cartridge 33.

Embodiment 2

FIG. 7A-FIG. 11B are drawings for describing the apparatus 100 in the second embodiment of the present invention. In this embodiment, a toggle mechanism is used as the mechanism for moving the unit 200 by utilizing the movement of the cover 10. The apparatus 100 in this embodiment is structured so that the cartridge positioning member is moved into the cartridge positioning position or moved out of the cartridge positioning position, by the rotational movement of the unit 200. The structural members, portions, etc., of the apparatus 100 in this embodiment, are the same as the counterparts in the first embodiment are given the same referential codes as those given to the counterparts, and will not be described here. In this embodiment, in order to keep the cartridges 33 pressed upon the units 32, one for one, so that a preset amount of pressure is maintained between the cartridges 33 and units 32, the frame 31 of the unit 300 is structured as follows. This structural arrangement will be described referring primarily to FIGS. 7A and 7B. In this embodiment, the frame 31 has a pressing portion 60*a* and pressing levers 60 (Y, M, C, and K). The pressing levers 60 have a gear-shaped portion 60*b* (pressing lever gear) for eliminating pressure. The frame 31 has also compression springs 61 (Y, M, C, and K) which keep the pressing levers 60 always pressed in the clockwise direction. It has also gears 63*a*-63*c* which are between adjacent two lever gears portions 60*b* and transmit driving force. The apparatus main assembly 100A has a separation gear 62, which is stationary. When the unit 200 is in the image forming position, the relationship between the gear portion 60*b* and gear 62 is such that the driving force is not transmitted. Therefore, the contacting portion 33*e* of the cartridge 33 is kept pressed by the lever 60 which is kept in the positioning position by the resiliency of the pressing spring 61 (elastic member). Thus, the shaft 33*b*-1 of the roller 33*b* is kept in contact with the positioning portion 39 (FIG. 5B). Therefore, it is ensured that the roller 33*b* is correctly positioned relative to the drum 32*a* ((b) of FIG. 2). Incidentally, the gear portion 60*b* may be an integral part of the pressing portion 60*a*, or a component independent from the pressing portion 60*a*.

The cover 10 is provided with a toggle bar 51, which is rotatable about the lever supporting point 51*c*. The lever 51 is provided with a boss 51*b*, which is engaged with a guide rail of the apparatus main assembly 100A. Thus, the movement of the lever 51 is regulated by this rail 52. Further, the lever 51 has a spring (35) anchoring portion 51*a*, which is at the opposite end from the supporting point 51*c*. Both FIGS. 7 and 8 show the apparatus 100 when the cover 10 of the apparatus main assembly 100A is in the closed position. As a user opens the cover 10, the lever 51 is rotationally moved by the movement of the cover 10. Thus, the anchoring portion 51*a* (projection) of the lever 51 is moved from the rear side of the dead center (shaft 45R) to the front side of the dead center (shaft 45R), as shown in FIG. 9. As a result, the unit 200 is pulled by the resiliency of the spring 35 in such a manner that it is rotated in the counterclockwise direction about the shaft 45L and 45R. Thus, the unit 200 rotates in the counterclockwise direction until it is caught by a stopper 37, which is the unit positioning portion of the apparatus main assembly 100A. More specifically, the unit 200 is rotationally moved roughly 40° in the counterclockwise direction from the transfer position A (FIGS. 8A and 8B). Next, referring to FIGS. 10A and 10B, as the unit 200 is moved as described above, the cartridges 33 are moved into the positions where they face the opening 100B, and are kept in the positions. In other words, as the cover 10 is opened, the unit 200 is moved into the position B in which the cartridges 33 can be mounted into, or dismounted from, the corresponding cartridge chambers 31*c*.

FIG. 11A is a partially broken perspective view of the apparatus 100, and FIG. 11B is a sectional view of the unit 200. They show the pressing levers 60 (Y, M, C, and K) when the unit 200 has just been rotationally moved from the transfer position A to the cartridge mounting-and-dismounting position B. As the unit 200 is rotated in the counterclockwise direction by a certain angle, the gear 62 is engaged with the gear 60*b*. Then, as the unit 200 is rotated further, the gear 60*b* is driven by the gear 62, whereby the pressing lever 60 is rotated in the counterclockwise direction about the gear 60*b* against the resiliency of the pressing lever spring 61 (elastic member). Thus, the pressing portions 60*a* simultaneously separate from the corresponding cartridges 33. That is, the levers (Y, M, C, and K), which are cartridge positioning members, are retracted from their cartridge positioning positions into their home positions, whereby the cartridges 33 are freed. As described above, when the unit 200 is in the topmost position (transfer position A), each lever 60 is in the cartridge positioning position Q1. However, while the unit 200 is moved to the cartridge mounting-and-dismounting position B, each lever 60 is retracted into the home position Q2. In other words, all that is necessary for a user to do to move the unit 200 from the transfer position A to the cartridge mounting-and-dismounting position B is to manually move the cover 10 from the closed position to the fully open position. Further, as the cover 10 is fully opened, the cartridges 33 are freed from the corresponding cartridge positioning members 60. In other words, this embodiment can realize the above-described structural arrangement for an image forming apparatus, which makes it possible to replace a cartridge or cartridges without retracting the unit 11. Therefore, it makes easier for a user to replace the cartridge 33. Further, when replacing cartridges, the cartridges can be kept roughly horizontal, or slightly tilted (in such direction that prevents toner from falling). Therefore, it is possible to prevent developer from falling into, and/or outside, the apparatus main assembly 100A when a user is replacing cartridges. Further, when the apparatus 100 is in an image forming operation, the cartridges 33 remain tilted in such a manner that the developers (toners) therein can be supplied to the corresponding development rollers with the utilization of their own weight. That is, this embodiment makes a toner stirring mechanism unnecessary, makes it possible to provide an image forming apparatus which is substantially lower in cost than conventional image forming apparatus, and also, can use up the developers in the cartridges.

Next, the process of moving the cartridges 33 into the transfer position A after the cartridge 33 or cartridges 33 are replaced, will be described. Referring to FIGS. 11A and 11B, each cartridge 33 is to be inserted into the corresponding cartridge chamber 31*c* of the unit 200 when the unit 200 is in the cartridge mounting-and-dismounting position B. As the cartridge 33 is mounted into the corresponding cartridge chamber 31*c*, the projection of the cartridge 33 engages with the elastic member c (FIG. 7B) of the cartridge chamber 31*c*, whereby the cartridge 33 is temporarily held in the cartridge chamber 31*c*. After the replacement of the cartridges to be replaced, a user is to rotationally move the cover 10, which is in the open position D, in the closing direction. As the cover 10 is rotationally moved, the lever 51 is rotationally moved, while being guided by the rail 52, by the rotational movement of the cover 10. Thus, the spring anchoring projection 51*a* of the lever 51 is moved from the rear side of the dead center (shaft 45R) to the front side of the dead center, by the movement of the lever 51. Thus, the unit 200 is rotationally moved in the clockwise direction about the shafts 45L and 45R by the rotational force applied to the unit 200 by the tension of the spring 35. Therefore, the unit 200 rotates in the clockwise direction until it is caught by the stay 38. That is, the unit 200 is rotated in the clockwise direction by roughly 45° from the cartridge mounting-and-dismounting position B (FIGS. 10A and 10B). Further, as the unit 200 is rotated in the clockwise direction by a certain angle from the cartridge mounting-and-dismounting position B, the positional relationship between the gear 62 and gear portion 60*b* becomes such that driving force is not transmitted. Thus, each lever 60 is moved into cartridge positioning position (FIG. 7B) from the home position (FIG. 11B) by the resiliency of the compression spring 61 (elastic member), coming into contact with the corresponding cartridge 33. Thus, the roller 33*b* is pressed upon the unit 32 by a preset amount of pressure, being thereby correctly positioned relative to the unit 32. That is, as the unit 200 is moved from the cartridge mounting-and-dismounting position B to the transfer position A, the roller 33*b* is correctly positioned relative to the drum 32*a*. Incidentally, each lever 60 may be made to double as an electrical contact of the cartridge 33. Not only does the above described structural arrangement for the image forming apparatus make it easier for a user to replace cartridges 33, but also, precisely position the cartridges 33 relative to the apparatus main assembly 100A.

Embodiment 3

FIGS. 12A and 12B are a drawing for describing the apparatus 100 in the third embodiment. This embodiment is basically the same as the second embodiment. Thus, this embodiment will be described utilizing the drawings used for describing the preceding embodiments. The apparatus 100 in this embodiment is the same as the apparatus 100 in the second embodiment, except for the following feature. In this embodiment, as a user manually opens the cover 10 when the cover 10 is in the closed state, the user is allowed to access a handle portion of the unit 200, which is for moving the unit 200. Therefore, the user is allowed to manually pull down the unit 200 into the cartridge mounting-and-dismounting position B. That is, as the user manually pulls down the unit 200 after opening the cover 10, it becomes possible for the cartridges 33 to be replaced. The frame 31 has: a spring 35 (elastic member) for keeping the unit 200 pressed in the clockwise direction; and a handle for a user to manually pull down the unit 200. The pressing of the cartridges 33, structural arrangement for correctly positioning the cartridges, and how each cartridge 33 is made to come into contact with, or separate from, the corresponding cartridge by the rotational movement of the frame 31, are the same as those in the second embodiment. Therefore, they will not be described here.

In this embodiment, it is not by the rotational movement of the cover 100 that the unit 200 is rotationally moved. More specifically, a user is to rotationally move the closed cover 10 into the preset open position for the cover 10, and then, to pull the unit 200 by grasping the handle 38. As the unit 200 is pulled downward, the unit 200 is rotationally moved into the cartridges mounting-and-dismounting position B, and is kept in the position B by the spring 35 of the toggle mechanism. That is, it becomes possible for the cartridges in the unit 200 to be replaced. The cartridge positioning mechanisms in this embodiment are the same as those in the second embodiment; they are the mechanisms 60-63 made up of levers 60. As the unit 200 is moved from the transfer position A into the cartridge mounting-and-dismounting position B, each lever 60 retracts from its cartridge positioning position into its home position. Thus, when the unit 200 is in the cartridge mounting-and-dismounting position B, the cartridges 33 are not restricted in movement by the levers 60. With the employment of the above described structural arrangement in this embodiment, the cartridges 33 in the unit 200 can be replaced without retracting the unit 11; a user can easily replace the cartridges 33 in the unit 200. Further, it is possible to prevent the problem that when a user is replacing the cartridges 33, the developers in the cartridges 33 fall into, and/or outside, the apparatus main assembly 100A. Further, it is possible to precisely position the cartridges 33 relative to the apparatus main assembly 100A. Moreover, the employment of the structural arrangement in this embodiment makes it possible to realize image forming apparatuses which are much simpler in structure, and substantially lower in cost, than any of the conventional image forming apparatuses.

After the cartridge replacement, the user is to move the unit 200 upward by grasping the handle 38. As the unit 200 is moved upward, the unit 200 is rotationally moved into the transfer position A, and is kept therein by the spring 35 of the toggle mechanism. Then, the user is to close the cover 10. Further, as the unit 200 is moved from the cartridge mounting-and-dismounting position B into the transfer position A, the retracted levers 60 are moved from their home positions into the cartridge positioning positions, whereby the cartridges 33 are correctly positioned relative to the unit 32.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 280308/2009 filed Dec. 10, 2009 which is hereby incorporated by reference.

What is claimed is:

1. A color electrophotographic image forming apparatus for forming a color image on a recording material, said color electrophotographic image forming apparatus comprising:

a plurality of cartridge mounting portions for demountably mounting cartridges, each of said cartridges including a developing roller for developing an electrostatic latent image formed on an electrophotographic photosensitive drum into a developed image and a developer accommodating portion for accommodating a developer to be used for development of the electrostatic latent image;

a single intermediary transfer member that is provided opposed to said electrophotographic photosensitive drums and onto which the developed images are transferred from said electrophotographic photosensitive drums;

an image forming unit containing said cartridge mounting portions and said intermediary transfer member, said image forming unit being movable between (i) a transfer position for transferring, onto the recording material, the developed images transferred onto said intermediary transfer member from said electrophotographic photosensitive drums and (ii) a mounting and demounting position for permitting mounting and demounting of said cartridges relative to said cartridge mounting portions; and an opening for permitting mounting and demounting of said cartridges relative to said cartridge mounting portions of said image forming unit taking the mounting and demounting position, wherein, when said image forming unit takes the transfer position, said cartridges take attitudes in which the developer in said developer accommodating portions is supplied to said developing roller by the weight thereof, and wherein said image forming unit is rotatable about a rotation axis of said intermediary transfer member between the transfer position and the mounting and demounting position.

2. An apparatus according to claim 1, wherein said cartridges are developing cartridges each containing said developing roller and said developer accommodating portion.

3. An apparatus according to claim 1, further comprising:

an opening-closing member that is movable between a closing position for closing said opening and an open position for opening an opening; and an interrelating member for moving said image forming unit from the transfer position to the mounting and demounting position in interrelation with movement of said opening-closing member from the closing position to the open position by manual operation, and for moving said image forming unit from the mounting and demounting position to the transfer position in interrelation with movement of said opening-closing member from an open position to a closing position by manual operation.

4. An apparatus according to claim 1, wherein when said image forming unit takes the mounting and demounting position, said cartridges take attitudes in which the developer in said developer accommodating portions is not supplied to said developing roller by the weight thereof.

* * * * *